US007791625B2

(12) United States Patent
Yamada et al.

(10) Patent No.: US 7,791,625 B2
(45) Date of Patent: Sep. 7, 2010

(54) THERMALHEAD, METHOD FOR MANUFACTURE OF SAME, AND PRINTING DEVICE PROVIDED WITH SAME

(75) Inventors: Hiroshi Yamada, Tokyo (JP); Kazuhito Uchida, Tokyo (JP); Tadashi Iino, Tokyo (JP); Suguru Andoh, Tokyo (JP); Hayato Miyashita, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/325,094

(22) Filed: Nov. 28, 2008

(65) Prior Publication Data

US 2009/0174758 A1 Jul. 9, 2009

(30) Foreign Application Priority Data

Nov. 30, 2007 (JP) ..... 2007-310649
Feb. 5, 2008 (JP) ..... 2008-024908

(51) Int. Cl.
*B41J 2/335* (2006.01)

(52) U.S. Cl. ..... 347/200

(58) Field of Classification Search ..... 347/200, 347/203, 208
See application file for complete search history.

(56) References Cited

U.S. PATENT DOCUMENTS 5,680,170 A * 10/1997 Taniguchi et al. ..... 347/208
5,745,147 A * 4/1998 Johnson et al. ..... 347/200
6,448,993 B1 * 9/2002 Hayashi et al. ..... 347/203

FOREIGN PATENT DOCUMENTS

| | | |
|---|---|---|
| JP | 63-166430 | 10/1988 |
| JP | 4-361079 | * 12/1992 |
| JP | 05-296154 | 11/1993 |
| JP | 8-207335 | 8/1996 |
| JP | 10-034990 | 2/1998 |
| JP | 2004-195947 | 7/2004 |

* cited by examiner

*Primary Examiner*—Huan H Tran
(74) *Attorney, Agent, or Firm*—Oblon, Spivak, McClelland, Maier & Neustadt, L.L.P.

(57) ABSTRACT

A thermal head that includes a bonding portion and a protective layer. The thermal head prevents electrostatic discharge damage from occurring in the bonding portion of the thermal head due to the protective layer being electrostatically charged.

12 Claims, 21 Drawing Sheets

FIG. 19

| Distance L (μm) | 0 | 10~20 | 50~60 | 90~100 |
|---|---|---|---|---|
| Occurrence Frequency (%) | 9.5 | 5.1 | 1.2 | 0.0 |

THERMALHEAD, METHOD FOR MANUFACTURE OF SAME, AND PRINTING DEVICE PROVIDED WITH SAME

TECHNICAL FIELD

The present invention relates to a thermal head, a method for manufacture of the thermal head, and a printing device provided with the thermal head. In particular, the present invention relates to: a thermal head to be mounted in various printing devices for business or consumer use; a method for manufacture of such thermal head; and a printing device mounted with such thermal head.

BACKGROUND OF THE INVENTION

There is a type of thermal heads used for thermal recording in various types of printing devices, such as the rewritable printers, the card printers, the video printers, the barcode printers, the label printers, the facsimile machines, and the ticket vending machines. This type of thermal heads heats the recording medium to a predetermined temperature to print information thereon or erase information therefrom. More specifically, a thermal head of this type is designed to selectively apply an electric potential to at least one heat element linearly disposed therein to generate heat. The recording medium reacts with the resulting heat energy. Characters or pictures are thereby printed on the recording medium. Alternatively, characters or pictures are thereby erased from the recording medium.

In a conventional thermal head, the protective layer rubs against the recording medium. The recording medium is, for example, a printing paper. The protective layer is thereby electrostatically charged. When the resulting electrostatic charge accumulation is discharged, this could damage the heat element or the bonding pad portion. There are techniques to prevent such electrostatic discharge damage. One such technique is a method of providing an electrically conductive film on the surface of the protective layer. For example, there is a technique disclosed in the prior art literature to provide an electrically conductive film on the protective film (or protective layer), the pattern of the conductive film being the same as that of the common electrodes or the individual electrodes (see Patent Document 1). There is also a prior art technique to provide an electrically conductive cermet film, thereby producing the resistance to abrasion and the electric conductivity (see Patent Document 2). There is also a prior art technique to cover the protective film with an electrically conductive film and remove the electrically conductive film configured to overlie the heat elements, thereby preventing electrostatic discharge damage and preventing refuse particles from being generated from the electrically conductive film due to this film frictionally sliding against the recording medium. This conductive film is connected to the ground potential via the circuit board by means of patterning (see Patent Document 3). This electrically conductive film is electrically connected to the ground potential of the circuit board by means of patterning (see Patent Document 3).

Patent Document 1 refers to JP5-286154A;

Patent Document 2 refers to JP 10-034990A; and

Patent Document 3 refers to JP 2004-195947A.

DISCLOSURE OF THE INVENTION

Problems to Be Solved by the Invention

Patent Documents 1 to 3 disclose merely providing an electrically conductive film on the surface of a protective layer. That is, the electrostatic charge generated by the conductive film and the recording medium sliding against each other may be thereby displaced outside the sliding area. However, the electrostatic charge is thereby not eliminated. This creates the problem of failing to produce a sufficiently advantageous effect in the case of high-speed printing, which easily generates electrostatic charge. In addition, because the electrostatic charge generated by the conductive film and the recording medium sliding against each other is merely displaced, and not eliminated, the displaced electrostatic charge could still cause electrostatic discharge damage. In particular, the disclosures in Patent Documents 1 to 3 do not teach how to sufficiently prevent electrostatic discharge damage from occurring in the bonding pad portion. In general, the accumulation of electrostatic charge grows with the increasing speed of printing speed. This prevents electrostatic charge from being sufficiently dissipated. All this has produced a growing demand for a new technique to overcome the above troubles. In addition, as disclosed in Patent Document 3 for example, the technique to ground the conductive film has the conductive film and the electrodes electrically connected to each other. This requires patterning, etc., the conductive film. This makes it difficult to adopt the technique in view of cost and yield. This also has resulted in a demand for another adequate technique.

In view of the above, the object of the present invention is to provide: a reliable thermal head designed to prevent electrostatic charge accumulated in the protective layer from causing electrostatic discharge damage in the heat element or in the bonding pad portion; a method for manufacture of such thermal head; and a printing device provided with such thermal head.

Means for Solving the Problems

An aspect of the present invention relates to a thermal head. This thermal head includes a heat element provided on a substrate; a wiring pattern electrically connected to the heat element; and a bonding pad portion; wherein the heat element is covered by a protective layer; wherein the substrate is secured to a metallic mount; and wherein the protective layer is electrically connected to the metallic mount.

This thermal head may be configured such that the protective layer is continuously formed to cover the heat element and a front wall and/or a side wall of the substrate and reach a backside of the substrate; and that the protective layer is electrically connected to the metallic mount in that the reaching by the protective layer of the backside of the substrate causes the substrate to contact the metallic mount.

This thermal head may be configured such that a surface resistance of the protective layer is $1\times10^{11}$ Ω/square or less when a first insulating layer is provided between the heat element and the protective layer.

This thermal head may be configured such that the first insulating layer provided between the heat element and the protecting layer, i.e., the first insulating layer, an electrically conductive layer, and a second insulating layer, in this order, are stacked one on another.

This thermal head may be configured such that a surface resistance of the protective layer is larger than $1\times10^{5}$ Ω/square and $1\times10^{11}$ Ω/square or less when an insulating layer is not provided between the heat element and the protective layer.

Another aspect of the present invention relates to a method of manufacture of a thermal head. This method includes steps of: forming heat elements on a raw substrate; forming wiring patterns electrically connected to the heat elements, along with bonding pad portions, respectively; dividing the substrate to produce divided substrates; continuously forming a protective layer so as to cover the heat element with the protective layer and then a front wall and/or a side wall of the divided substrate and to further extend to a backside of the divided substrate; and joining the divided substrate and a metallic mount so as to electrically connect the protective layer configured to extend to the backside of the substrate with the metallic mount via an electrically conductive adhesive.

Another aspect of the present invention relates to a thermal head. This thermal head includes: a heat element provided on a substrate; a wiring pattern electrically connected to the heat element; an insulating layer formed both on the wiring pattern and the heat element; a protective layer formed on the insulating layer; and a bonding pad portion configured as a part of the wiring pattern and exposed from the insulating layer; wherein a distance from an end of the protective layer to the bonding pad portion is larger than 10 μm.

This thermal head may be configured such that the distance from the end of the protective layer to the bonding pad portion is larger than 50 μm.

This thermal head may be configured such that the distance from the end of the protective layer to the bonding pad portion is larger than 90 μm.

The thermal head may be configured such that the protective layer is electrically connected to a metallic mount, the metallic mount designed to have the substrate secured thereon.

Another aspect of the present invention relates to a printing device using the above thermal head.

Another aspect of the present invention relates to a method for manufacture of a thermal head. This method includes steps of: forming a heat element on a raw substrate; forming a wiring pattern electrically connected the heat element, along with a bonding pad portion; covering the wiring pattern and the bonding pad portion with an insulating layer; removing a part of the insulating layer configured to cover the bonding pad portion; and covering the heat element with a protective layer such that the heat element and the bonding pad portion are spaced apart from each other by a predetermined distance or more.

ADVANTAGEOUS EFFECT OF THE INVENTION

According to the present invention, the protective layer is electrically connected to the metallic mound. This allows electrostatic charge accumulated on the surface of the protective layer during printing to be dissipated to ground. This in turn prevents electrostatic discharge damage from occurring in the heat elements or the bonding pad portion. This makes it possible to provide a reliable thermal head and a reliable printing device provided with the thermal head.

From another viewpoint, the protective layer and the bonding pad portion are spaced apart from each other by a predetermined distance, thereby preventing electrostatic discharge damage accumulated in the protective layer from causing electrostatic discharge damage in the bonding par portion. This makes it possible to provide a reliable thermal head, a method for manufacture of such thermal head, and a printing device provided with such thermal head.

BRIEF DESCRIPTION OF THE DRAWINGS

FIGS. 18(*b*) and (*c*) are each a cross sectional view of a variant example according to the sixth embodiment of the present invention.

FIG. 19 is a table showing the test results regarding the relation between the distance L and the occurrence frequency of electrostatic corrosions, the distance L extending from the end of the protective layer to the end of the boding pad portion.

BEST MODE FOR CARRYING OUT THE INVENTION

First Embodiment

Figure 1:
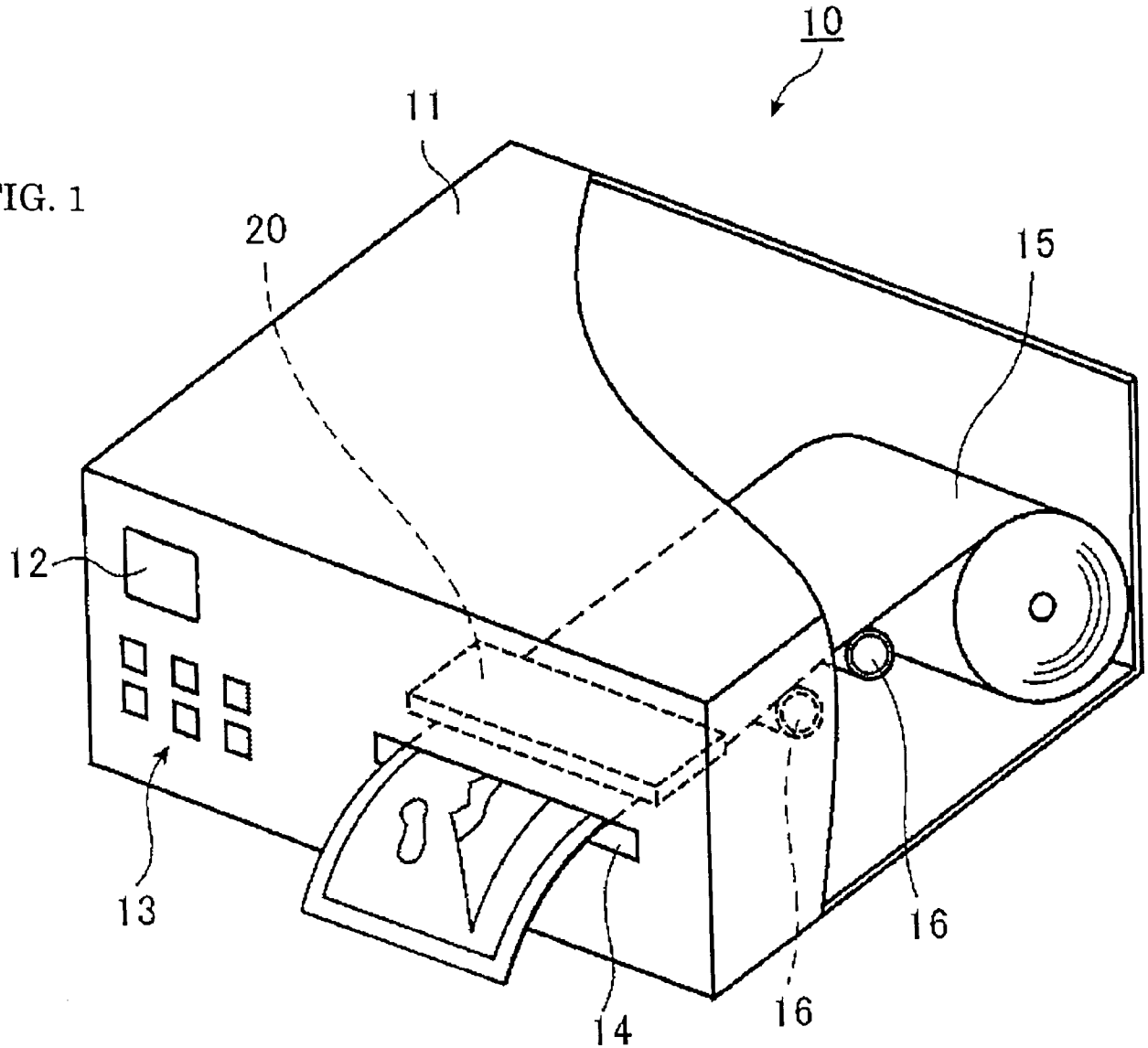
FIG. 1 is a general view of the printing device according to the first embodiment of the present invention.

FIG. 1 is a schematic view of a printing device 10 equipped with a thermal head according to an embodiment of the present invention. The printing device 10 has a hexahedral casing 11. The front face of the casing 10 is provided with a liquid crystal panel 12, an input keyboard 13, and a paper outlet 14. The casing 11 accommodates a thermal paper 15. The paper 15 is wound into a roll. The front portion of the thermal paper 15 is supported by plural transport rollers 16 so as to be positioned ahead of a paper outlet 14. The casing 11 incorporates a thermal head unit 20. The unit 20 includes a thermal head. The unit 20 is located above the paper 15. The unit 20 produces characters, images, etc., on the paper 15 by heating the paper 15 for color development. This is a printing operation performed by the unit 20. After printing, the paper 15 is ejected from the outlet 14.

Figure 2:
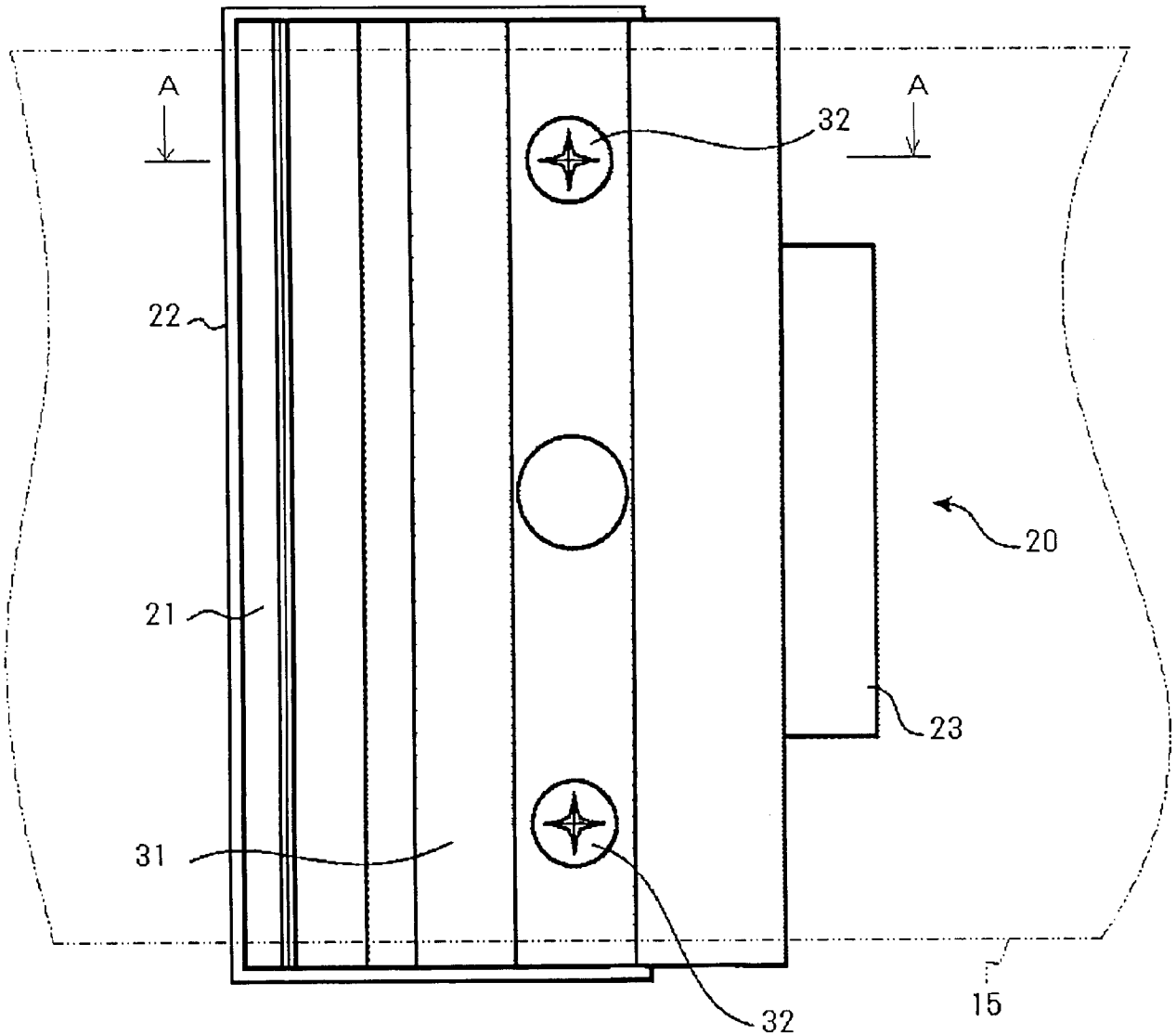
FIG. 2 is a plan view of the thermal head unit of the printing device according to the first embodiment of the present invention.
Figure 3:
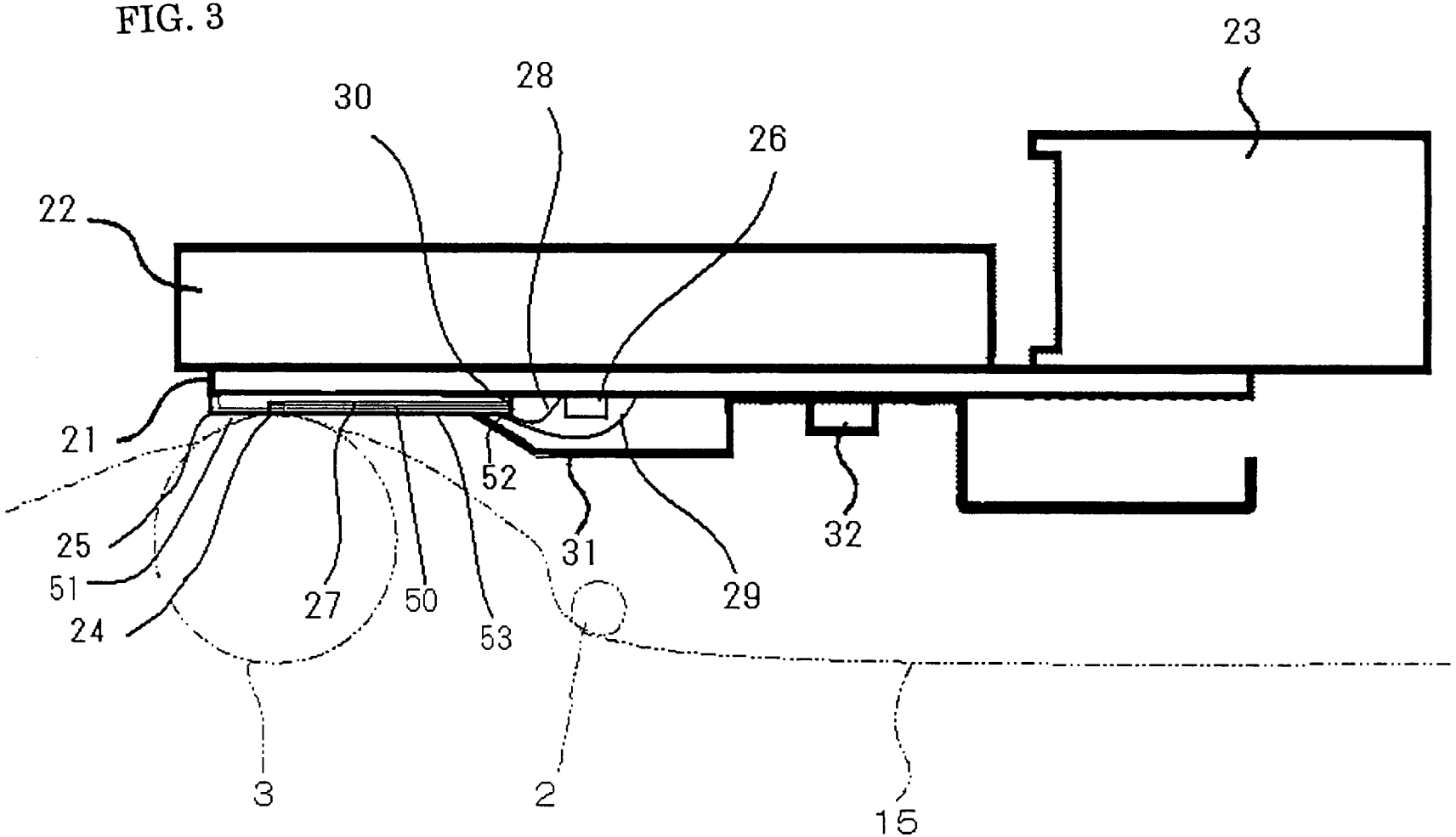
FIG. 3 is a side view of the thermal head of the printing device according to the first embodiment of the present invention.

FIG. 2 is a plan view of the thermal head unit 20 as seen from below. FIG. 3 is a cross sectional view of the unit 20 shown in FIG. 2. This cross sectional view is taken along the line A-A shown in FIG. 2. As shown in FIGS. 2 and 3, the unit 20 includes a mount 21. The mount 21 is made of metal, such as aluminum. The upper surface of the mount 21 has a heat sink 22 and a connector 23 attached thereon. The lower surface of the mount 21 has a substrate 25 and an integrated circuit (IC) 26 attached thereon. The substrate 25 has plural heat elements 24. The following will be detailed later with reference to FIG. 6. The substrate 25 has a wiring pattern 27 and a bonding pad portion 52 provided thereon. The pattern 27 is connected to the elements 24. The elements 24 and the pattern 27 are covered by an insulating layer 50. Part of the insulating layer 50 is covered by a protective layer 51. Part of the insulating layer 50 is covered by a resin layer 53. The pattern 27 and the circuit 26 are electrically connected to each other. This is realized by connecting a terminal of the circuit 26 and the portion 52 via a bonding wire 28.

The circuit 26 and the wire 28 are protected by being covered by a protective resin 29. The resin 29 is formed from a hard resin, such as an epoxy resin. The substrate 25 and the mount 21 are provided with a step 30. The step 30 serves to prevent the resin 29 from interfering with the recording medium. The resin 29 extends so as to straddle the step 30. The mount 21 has an IC cover 31 attached thereon via a screw 32. FIGS. 2 and 3 show a thermal paper 15. The paper 15 is indicated by an alternate long and two short dashes line. The paper 15 is guided by a roller 2. The roller 2 is shown in FIG. 3. The roller 2 serves to press the paper 15 against the thermal head so that heat from the heat elements 24 causes characters, images, etc., to be printed on the paper 15.

Figure 4:
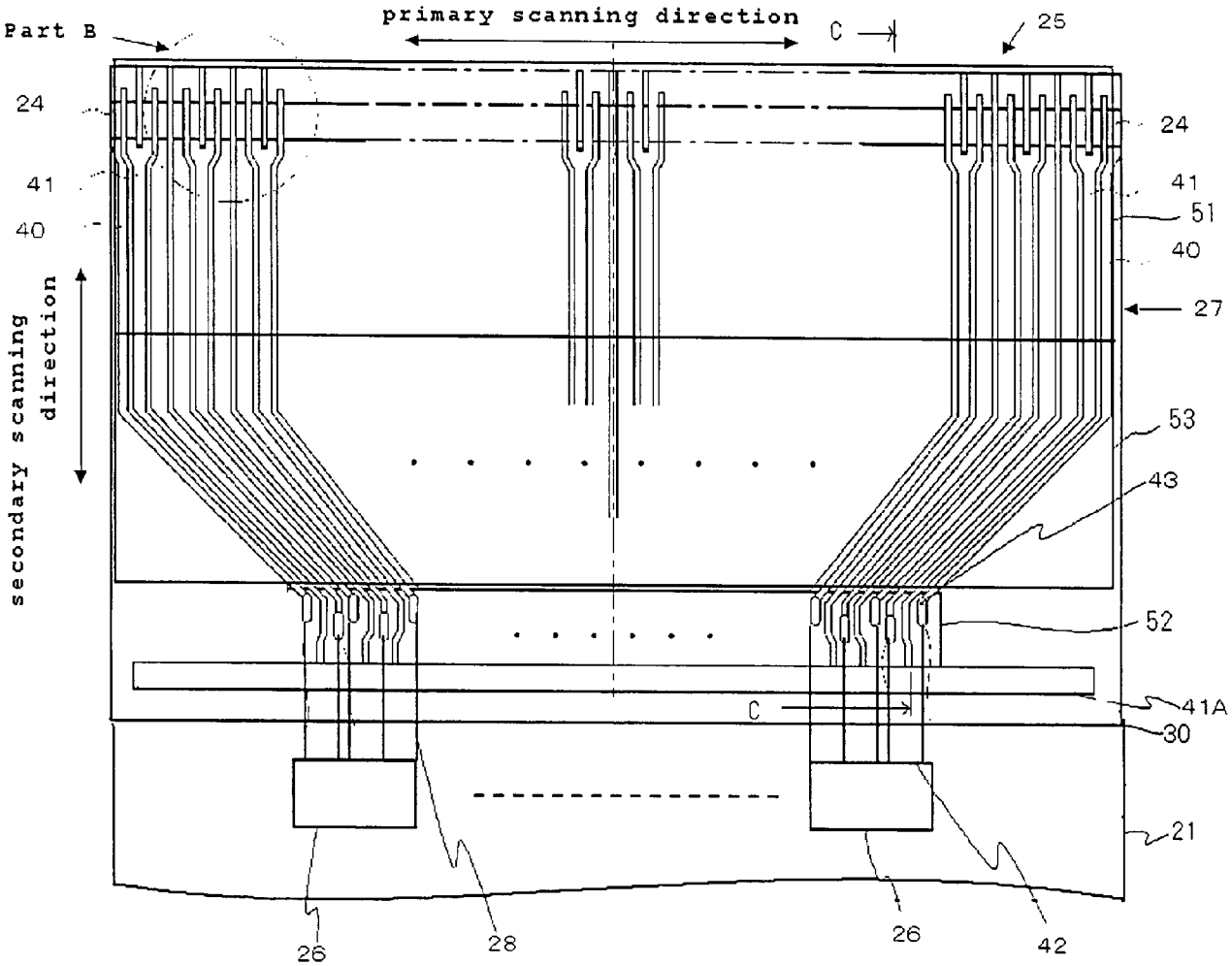
FIG. 4 is a schematic plan view of the thermal head according to the first embodiment of the present invention.

FIG. 4 is a partial plan view of the mount 21 and part of the substrate 25 as seen from below. The IC cover 31 is removed.

As shown in FIG. 4, the wiring pattern 27 on the substrate 25 contains plural individual electrodes 40 and plural common electrodes 41. The electrodes 40 and the electrodes 41 are alternately disposed side-by-side. The electrodes 40 and 41 are each oriented parallel to the secondary scanning direction. One common electrode 41 corresponds to two individual electrodes 40. That is, one of a pair of individual electrodes 40 is disposed on one side of a common electrode 40; the other of the pair of individual electrodes 41 is disposed on the other side of the common electrode 41. This constitutes one pattern. This pattern is consecutively repeated.

The individual electrodes 40 and the common electrodes 41 are formed via the steps of forming an electrically conductive film, exposure (patterning), etc. The individual electrode 40 may be formed so as to approximately have a film thickness of, for example, 0.2 to 1 micrometer and a line width of, for example, 30 to 70 micrometers. The common individual 41 may be formed so as to have a film thickness of 0.2 to 1 micrometer and a line width of 30 to 70 micrometers.

The proximal end of each individual electrode 40 has a bonding pad portion 52 formed thereon. The portion 52 has an electrode pad 43. The pad 43 is connected to a lead terminal 42 of the integrated circuit 26 mounted on the mount 21. The proximal end of each common electrode 41 has a common electrode portion 41A formed thereon. The portions 41A are disposed along the primary scanning direction. The lead terminal 42 and the electrode par 43 are connected to each other via the bonding wire 28. The heat elements 24 and the wiring pattern 27 are covered by the insulating layer 50 (see FIG. 6). Part of the insulating layer 50 is covered by the protective layer 51. Part of the insulating layer 50 is covered by the resin layer 53. The insulating layer 50 is made of $SiO_2$, SiON, etc. The layer 51 is made of SiBP, etc. The layer 53 is made of an epoxy resin, a photosensitive resin, etc.

On one side of the entirety of the individual electrodes 40 and the common electrodes 41, the side having all the distal ends of the entirety of the electrodes 40 and 41 located thereon, the heat elements 24 are disposed along the primary scanning direction. The elements 24 are insulated against each other. The element 24 is exposed so as to approximately have a film thickness of, for example, 0.1 to 0.6 μm and a line width in the secondary scanning direction of, for example, 30 to 200 μm.

Figure 5:
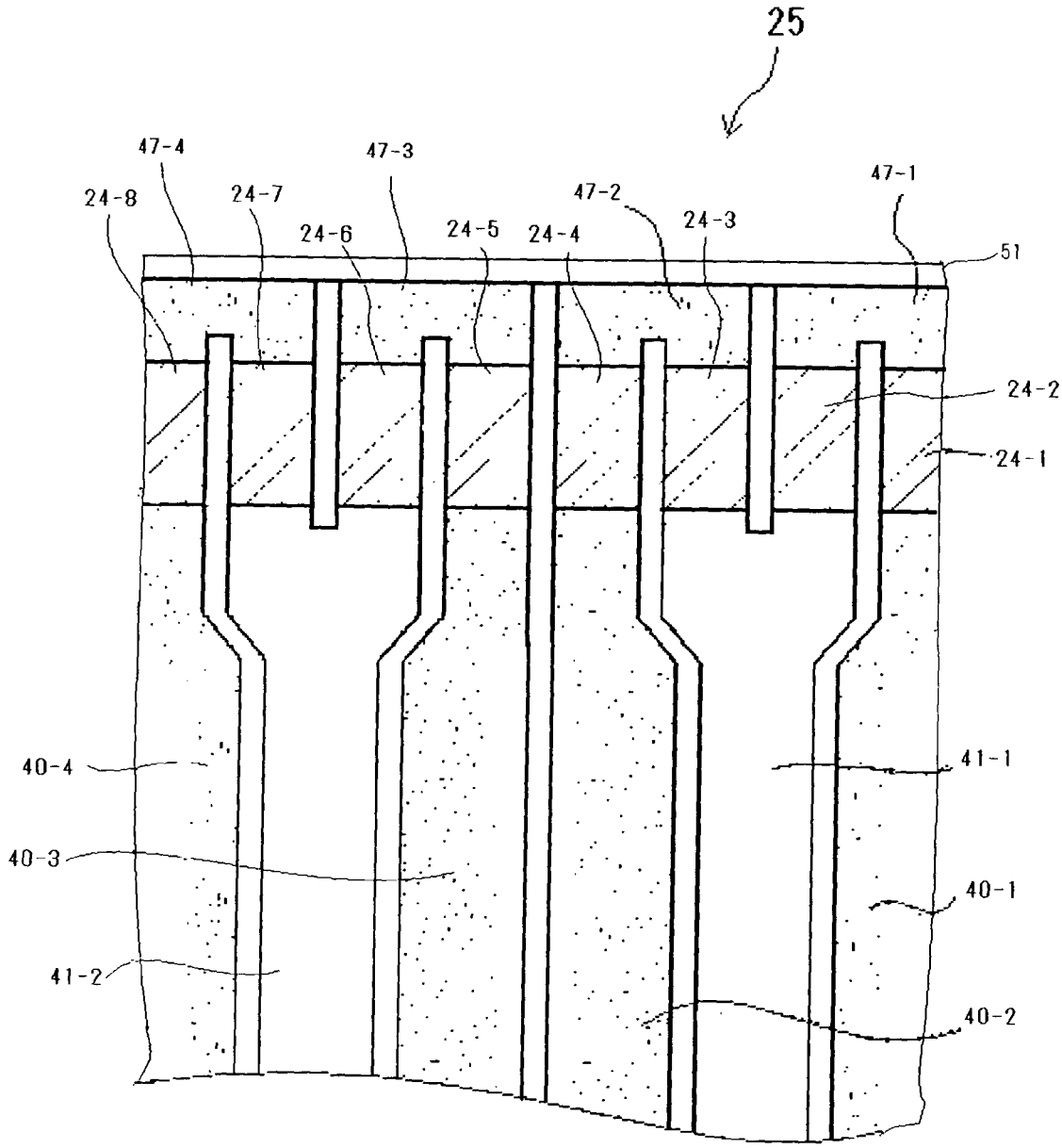
FIG. 5 is an enlarged view of the part B in FIG. 4.

FIG. 5 is an enlarged view of part B shown in FIG. 4. For the ease of explanation, the following will be adopted. The first four individual electrodes 40 from right will be referred to as the individual electrodes 40-1 to 40-4. The first eight heat elements 24 from right will be referred to as the heat elements 24-1 to 24-8. The first two common electrodes 41 will be referred to as the common electrodes 41-1 and 41-2. Regarding electrodes 47, the first four electrodes 47 from right will be referred to as the electrodes 47-1 to 47-4. In the descriptions with reference to FIG. 6 and to the subsequent figures, the electrodes 47 will also be referred to as the wiring pattern 47.

The first individual electrode 40-1 is connected to one end (shown below) of the first heat element 24-1. The other end (shown above) of the first heat element 24-1 is connected to the first electrode 47-1. One end of the second heat element 24-2 is connected to the first electrode 47-1. The other end is connected to the first common electrode 41-1. The first common electrode 41-1 is connected to one end of the third heat element 24-3. The other end of the third heat element 24-3 is connected to the second electrode 47-2. One end of the heat element 24-4 is connected to the second electrode 47-2. The other end is connected to the second individual electrode 40-2. The third individual electrode 40-3 is connected to one end of the fifth heat element 24-5. The other end of the fifth heat element 24-5 is connected to the third electrode 47-3. One end of the sixth heat element is connected to the third electrode 47-3. The other end is connected to the second common electrode 41-2. The second common electrode 41-2 is connected to one end of the seventh heat element 24-7. The other end of the seventh heat element is connected to the fourth electrode 47-4. One end of the eighth heat element 24-8 is connected to the fourth electrode 47-4. The other end is connected to the fourth individual electrode 40-4. A set of the first and second heat elements 24-1 and 24-2, a set of the third and fourth heat elements 24-3 and 24-4, a set of the fifth and sixth heat elements 24-5 and 24-6, and a set of the seventh and eighth heat elements 24-7 and 27-8 constitutes each one dot. The common electrode configured in such a manner is generally referred to as a U-turn common electrode.

In FIG. 5, if, for example, the first individual electrode 40-1 and the first common electrode 41-1 have voltage applied thereto, respectively, electric current flows through the first individual electrode 40-1, the first heat element 24-1, the first electrode 47-1, the second heat element 24-2, and the first common electrode 41-1. This causes the first heat element 24-1 and the second heat elements 24-2 to generate heat.

Figure 6:
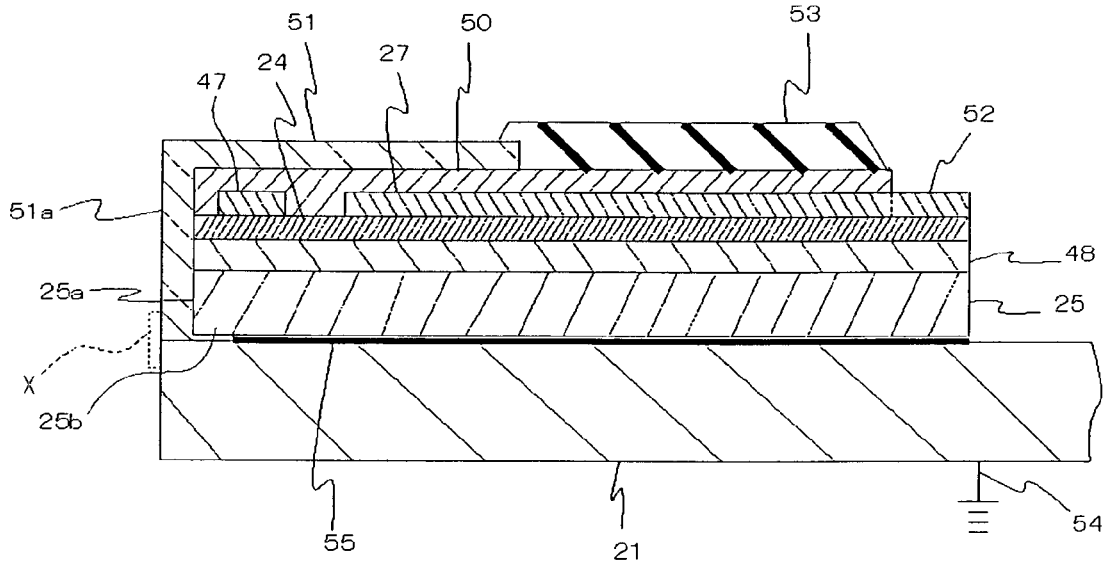
FIGS. 6(*a*) and (*b*) are a cross sectional view of FIG. 4 taken along the line C-C and a cross sectional view of a variant example.
Figure 6:
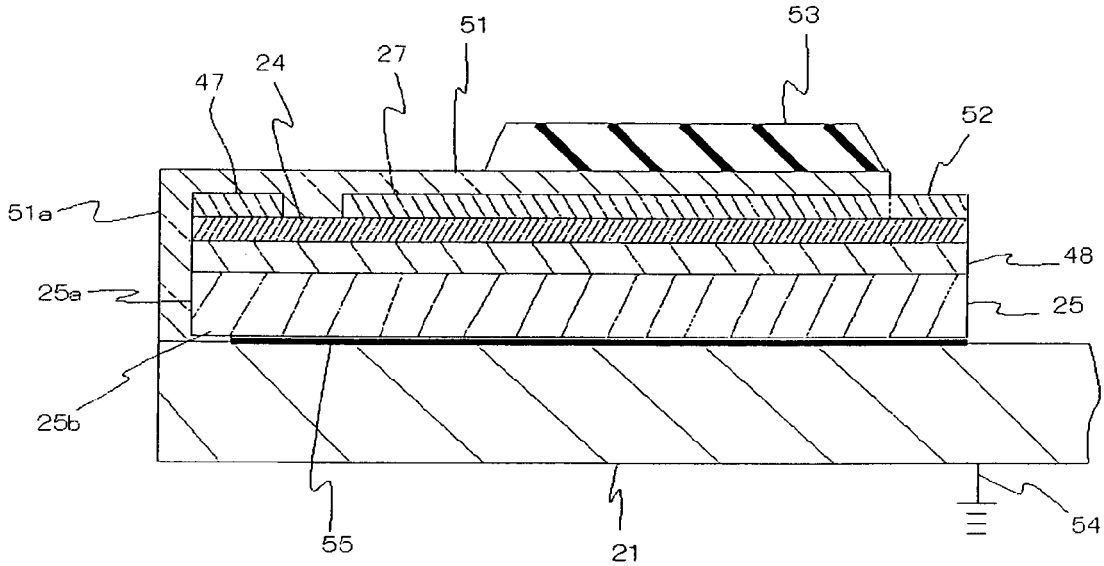

FIG. 6(*a*) is a cross sectional view taken along the line C-C shown in FIG. 4. The substrate 25 adhered to the mount 21 has a glaze 48 formed thereon. The glaze 48 has the heat elements 24 provided thereon. The heat elements 24 are spaced apart from each other by a predetermined distance in the longitudinal direction (corresponding to a direction vertical to the plane of paper containing FIG. 6(*a*)) of the glaze 48. The glaze 48 is also provided with the wiring patterns 27 and 47 and the bonding pad portion 52. The wiring patterns 27 and 47 are spaced apart from each other by a predetermined distance in the longitudinal direction (a direction vertical to the plain of paper containing FIG. 6(*a*)) of the thermal head. The wiring patterns 27 and 47 are formed by removing the conductive layer such that part of the entire area of the heat elements 24 is exposed. The heat elements 24 and the wiring patterns 27 and 47 are covered by the insulating layer 50. Part of the insulating layer 50 is covered by the protective layer 51. Part of the insulating layer 50 is covered by the resin layer 53. The protective layer 51 is continuously formed so as to cover a front wall 25*a* of the substrate 25 and to extend to the backside 25*b* of the substrate 25. The protective layer 51, which is thus formed to extend to the backside 25*b* of the substrate, is then electrically connected with the metallic mount 21. This is realized by adhering the substrate 25 on the mount 21 via an electrically conductive adhesive 55, etc. The mount 21 is grounded. This is indicated by reference number 54. The resin layer 53 is made of an epoxy resin. The surface resistance of the layer 51 is preferably $1\times10^{11}$ Ω/square or less in order to obtain the effect of eliminating electrostatic charge. The layer 51 and the wiring pattern 47, which is constituted by a layer composed of electrodes, are prevented from contacting each other by the leftmost portion of the left end of the pattern 47 being replaced by the corresponding portion of the insulating layer 50. In order to improve the electrical connection between the mount 21 and the protective layer 51 (51*a*) configured to extend first straight and then curve generally in a U form to form a curved portion 51*a*, the area indicated by the area X may be provided with an electrically conductive material, such as an electrically conductive adhesive. In this configuration, it is possible to use a general adhesive instead of an electrically conductive adhesive for adhering the mount 21 and the substrate 25 to each other. As can be seen from a variant example shown in FIG. 6(*b*), it is possible to cover the heat elements 24 and the wiring patterns 27 and 47 directly with the protective layer 51 without providing the insulating layer 50. In this case, the layer 51 has preferably a surface resistance of more than $1\times10^{6}$ Ω/square to $1\times10^{11}$ Ω/square inclusive in order to avoid electrical leakage. In this variant example, it is not necessary to avoid contact between the layer 51 and the pattern 47, as opposed to FIG. 6(*a*). Therefore, the left end of the pattern 47 and the left end of the heat elements 24 may be made to be flush with each other as shown FIG. 6(*b*). That is, the leftmost portion of the left end of the pattern 47 does not need to be removed. It is a matter of course that, in this variant example also, the portion corresponding the area X may be provided with an electrically conductive material in order to improve the electrical connection between the mount 21 and the layer 51 or the portion 51*a* thereof configured to be bent downward toward the mount 21, which is the case with FIG. 6(*a*). This is also the case with an embodiment that will be described later.

The following configuration has been described above. The protective layer 51 is continuously formed so as to cover a front wall 25*a* of the substrate 25 and to extend to the backside 25*b* of the substrate 25. The protective layer 51, which is thus formed to extend to the backside 25*b* of the substrate, is then electrically connected with the metallic mount 21. This is realized by adhering the mount 21 on the substrate 25 via an electrically conductive adhesive 55, etc. This configuration makes it possible to dissipate the electrostatic charge accumulated on the surface of the layer 51 during printing operation to ground through the portion 51*a* covering the front wall 25*a* of the substrate 25 and through the mount 21. This prevents electrostatic discharge damage from occurring in the heat elements 24 and in the bonding pad portion 52. The area between the layer 51 and the portion 52 is covered by the resin layer 53. In addition, the layer 51 and the portion 52 are spaced apart by an appropriate distance. This prevents electrostatic discharge damage from occurring in the layer 51 and in the portion 52. This makes it possible to obtain a highly reliable thermal head and a highly reliable printing device provided with the thermal head.

A method for manufacture of a thermal head according to the embodiment of the present invention will be described below with reference to FIGS. 7 to 13 in the accompanying drawings.

Figure 7:
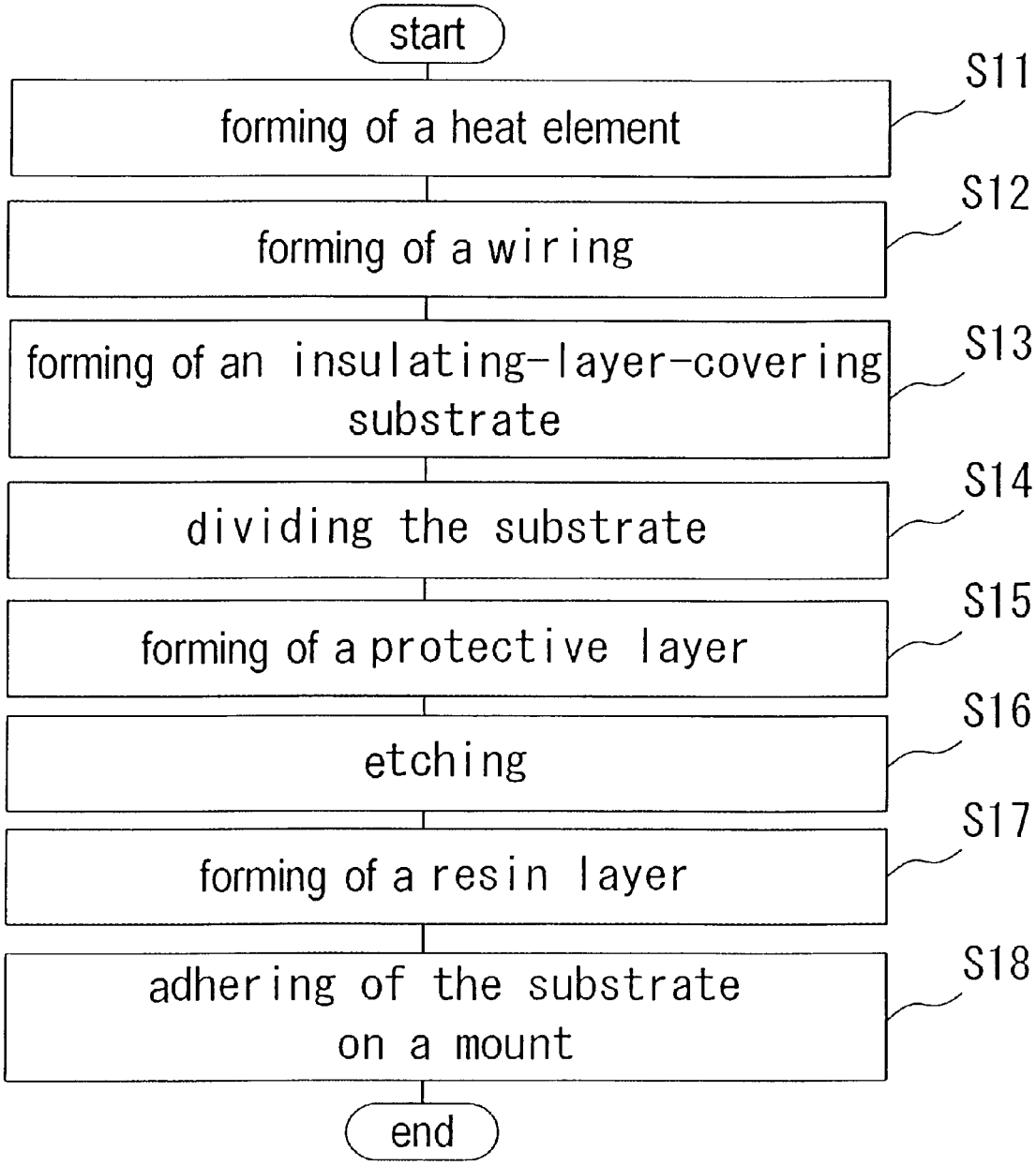
FIG. 7 is a flow chart of the method of manufacture of the thermal head according to the first embodiment of the present invention.
Figure 8:
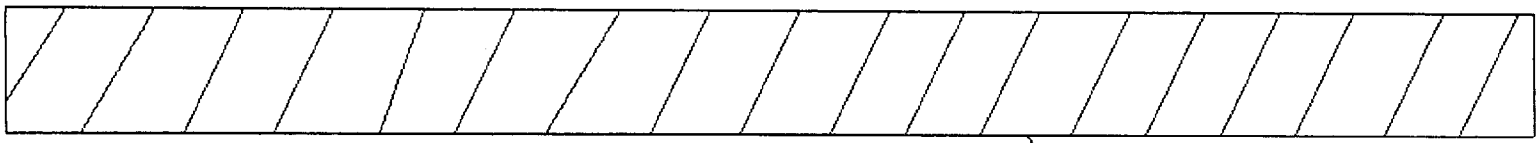
FIG. 8 is a cross sectional view of the thermal head formed on a substrate during manufacture of the thermal head according to the first embodiment of the present invention.
Figure 8B:
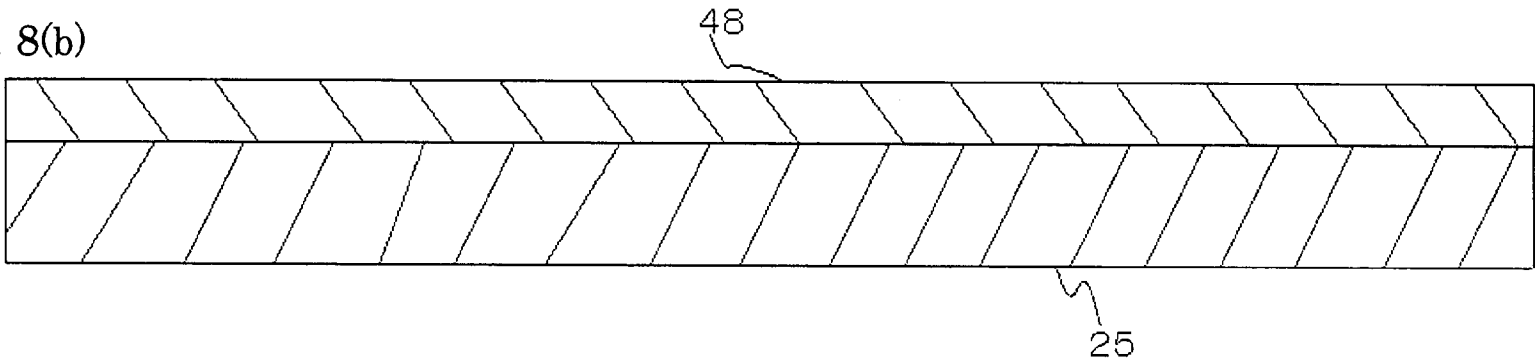
Figure 8:
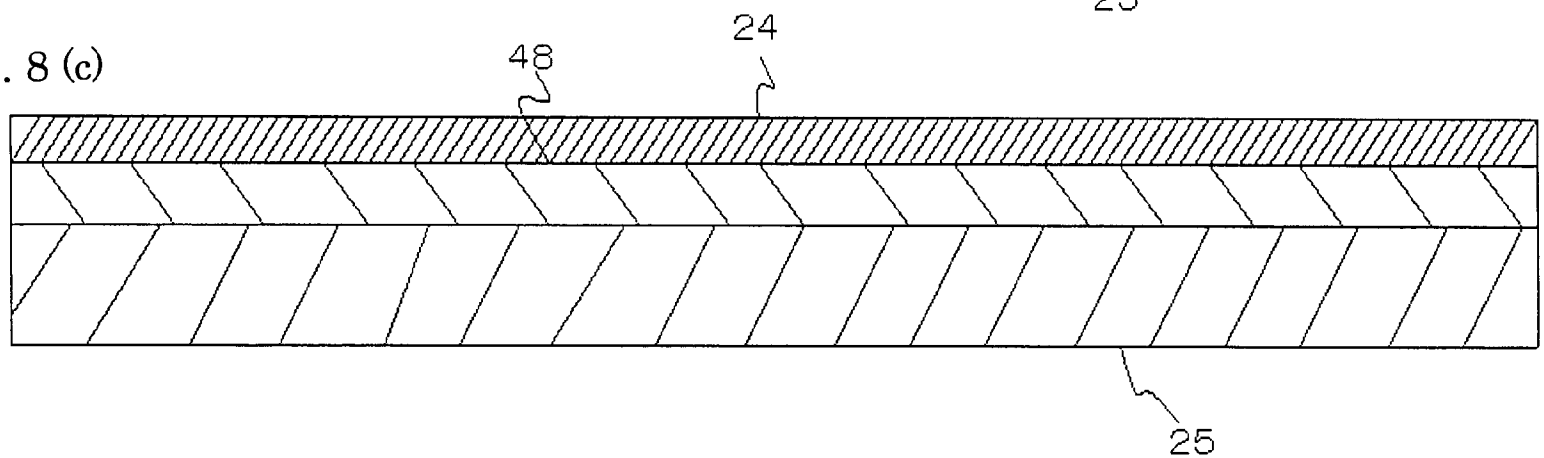
Figure 9A:
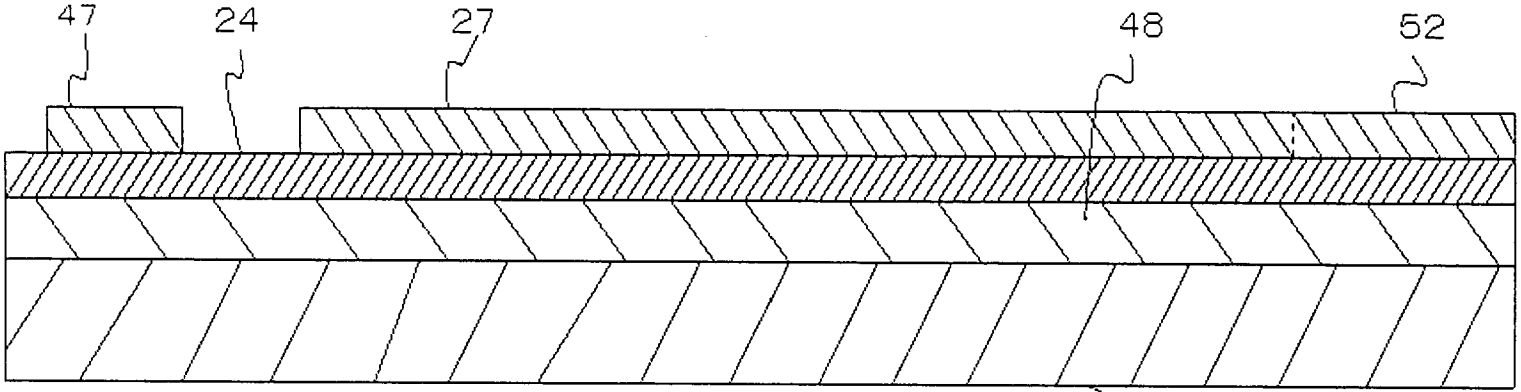
FIGS. 9(*a*) and (*b*) are each cross sectional view of the thermal head formed on the substrate during manufacture of the thermal head according to the first embodiment of the present invention.
Figure 9B:
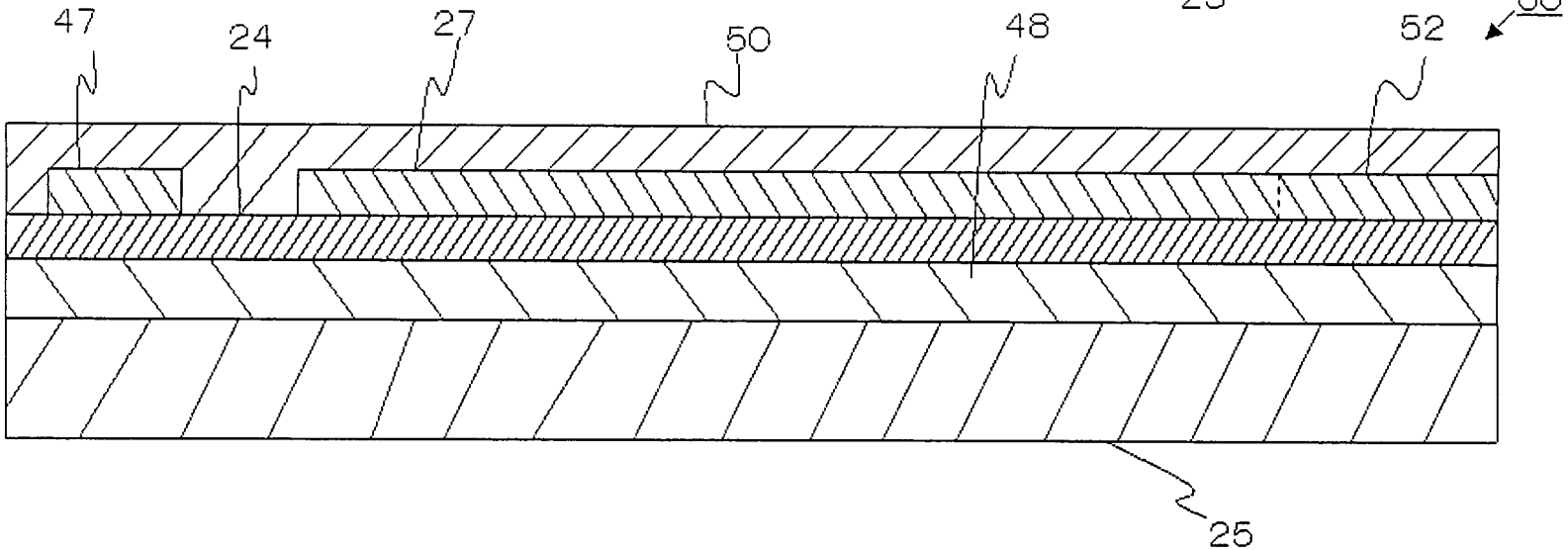

FIG. 7 is a flow chart illustrative of a method for manufacture of a thermal head according to the embodiment of the present invention. FIGS. 8 to 13 are each a cross sectional view of a thermal head formed on the substrate 25. The method for manufacture of a thermal head includes the steps of: forming the heat elements 24 on the substrate 25 (step S11); forming the wiring patterns 27 and 47 for providing electrical power to the heat elements 24, along with the bonding pad portion 52, on the substrate 25 (step S12); forming an insulating-layer-covering substrate 60 configured to have the patterns 27 and 47 and the portion 52 covered with the insulating layer 50 (step S13); dividing the substrate 60 (step S14); masking the substrate 60, which has been thus divided, so as to expose a portion of the substrate 60, the portion covering the protective layer 51 located on the side having the heat elements 24 located thereon and stack the layer 51 on the substrate 60 (step S15); dry etching the insulating layer 50 covering the portion 52 to remove the insulating layer 50 (S16); covering the insulating layer 50 with the resin layer 53 (step S17); and disposing and securing the substrate 25, the heat elements 24 and the integrated circuit 26 on the mount 21, electrically connecting the elements 24 and the circuit 26 via the bonding wire 28, and applying the epoxy resin so as to cover the circuit 26 and the wire 28 to subsequently cure the epoxy resin (step S18).

First, the step of forming the heat elements 24 on the substrate 25 (step S11) will be described in the following. The substrate 25 (FIG. 8(*a*)) has the glaze 48 formed thereon (FIG. 8(*b*)). This is realized by screen printing, etc. The glaze 48 has the heat elements 24 formed thereon. This is realized by the thin film forming technique (FIG. 8(*c*)). This technique is, for example, the vacuum evaporation, the chemical vapor deposition (CVD), the sputtering, etc. The low pressure CVD (LP-CVD), for example, is used to form the heat elements 24 on the glaze 48. Subsequently, the photolithography and the etching are used so as for the heat elements 24, which has been thus formed as thin films, to be spaced apart from each other by a predetermined distance in the longitudinal direction (corresponding to a direction vertical to the plane of paper containing FIG. 8) of the glaze 48.

The step of forming the wiring patterns 27 and 47, and the bonding pad portion 52 (step S12) will be described in the following. The whole surface of the heat elements 24 of the substrate 25 has an electrically conductive layer formed thereon. The conductive layer is configured to have a desired thickness. The conductive layer is later etched, thereby resulting in the wiring patterns 27 and 47. The conductive layer may be formed by the thin film forming technique, such as the sputtering. The conductive layer may also be formed by the screen printing method. The conductive layer is then patterned via the photolithography and the etching into a desired configuration. More specifically, the wiring patterns 27 and 47 are formed to be spaced apart from each other by a predetermined distance in the longitudinal direction (corresponding to the primary scanning direction) of the thermal head, as shown in FIG. 4. In addition, the conductive layer is partially removed so as to expose part of the whole area of the heat elements 24, thereby resulting in the wiring patterns 27 and 47 and the bonding pad portion 52 (FIG. 9(*a*)).

The step of forming an insulating-layer-covering substrate 60 configured to have the patterns 27 and 47 and the portion 52 covered with the insulating layer 50 (step S13) will be described in the following. The heat elements 24 and the wiring patterns 27 and 47 have an inorganic substance, such as $SiO_2$, etc., stacked thereon via the sputtering, etc., to form the insulating layer 50 (FIG. 9(*b*)).

In the step S14, the substrate 60 is divided into at least two portions.

Figure 10:
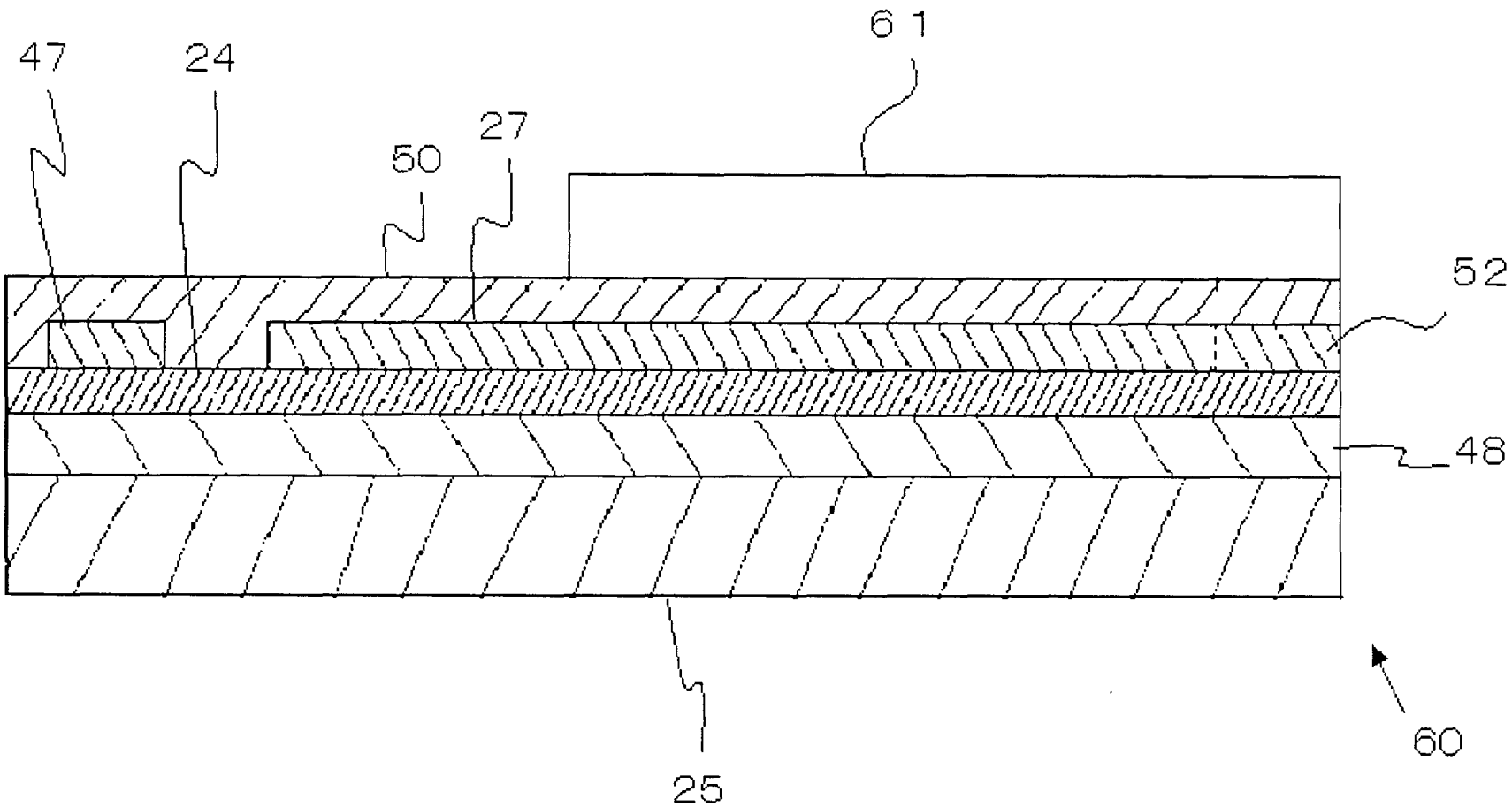
FIG. 10 is a cross sectional view of the insulating-layer-covering substrate masked for forming the protective layer.
Figure 11:
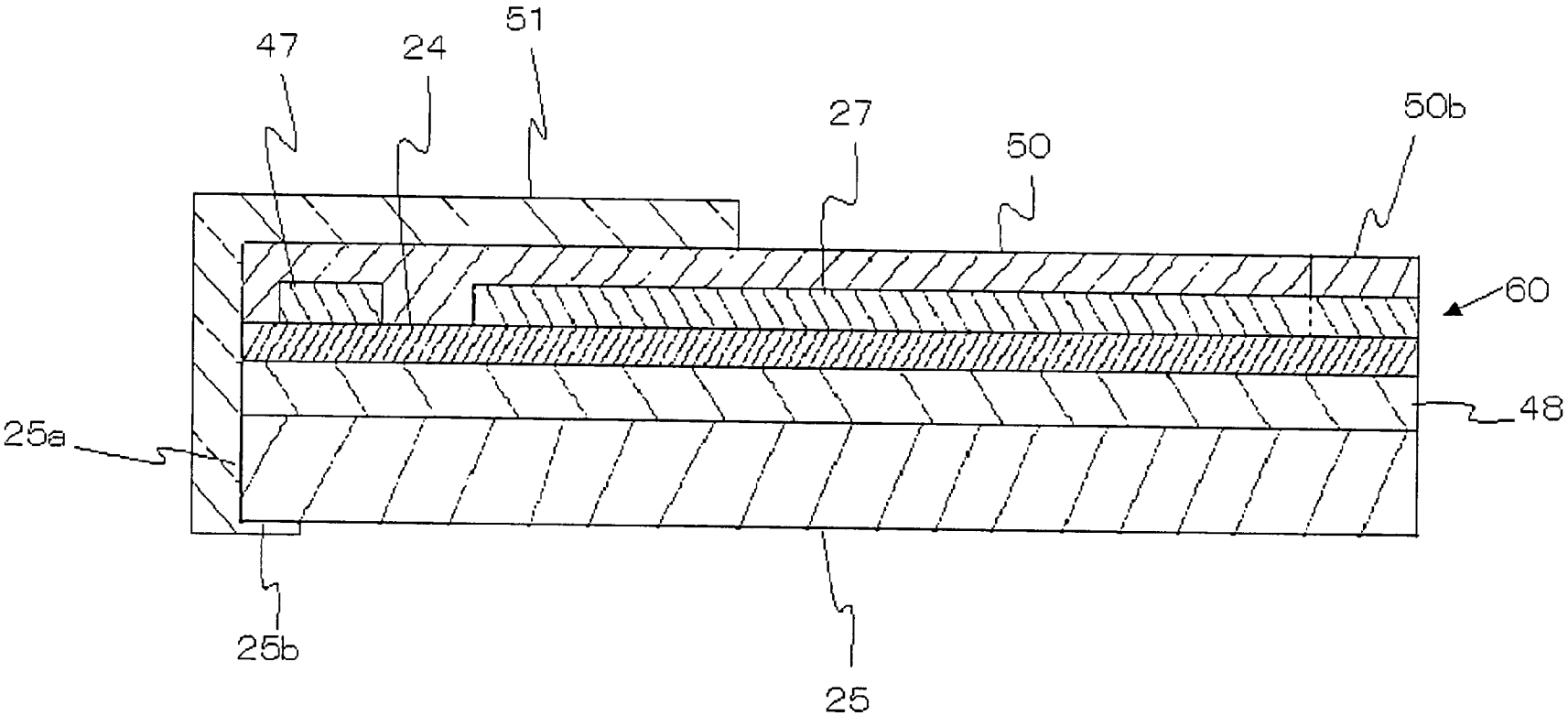
FIG. 11 is a cross sectional view of the thermal head formed on the substrate during manufacture of the thermal head according to the first embodiment of the present invention.
Figure 12:
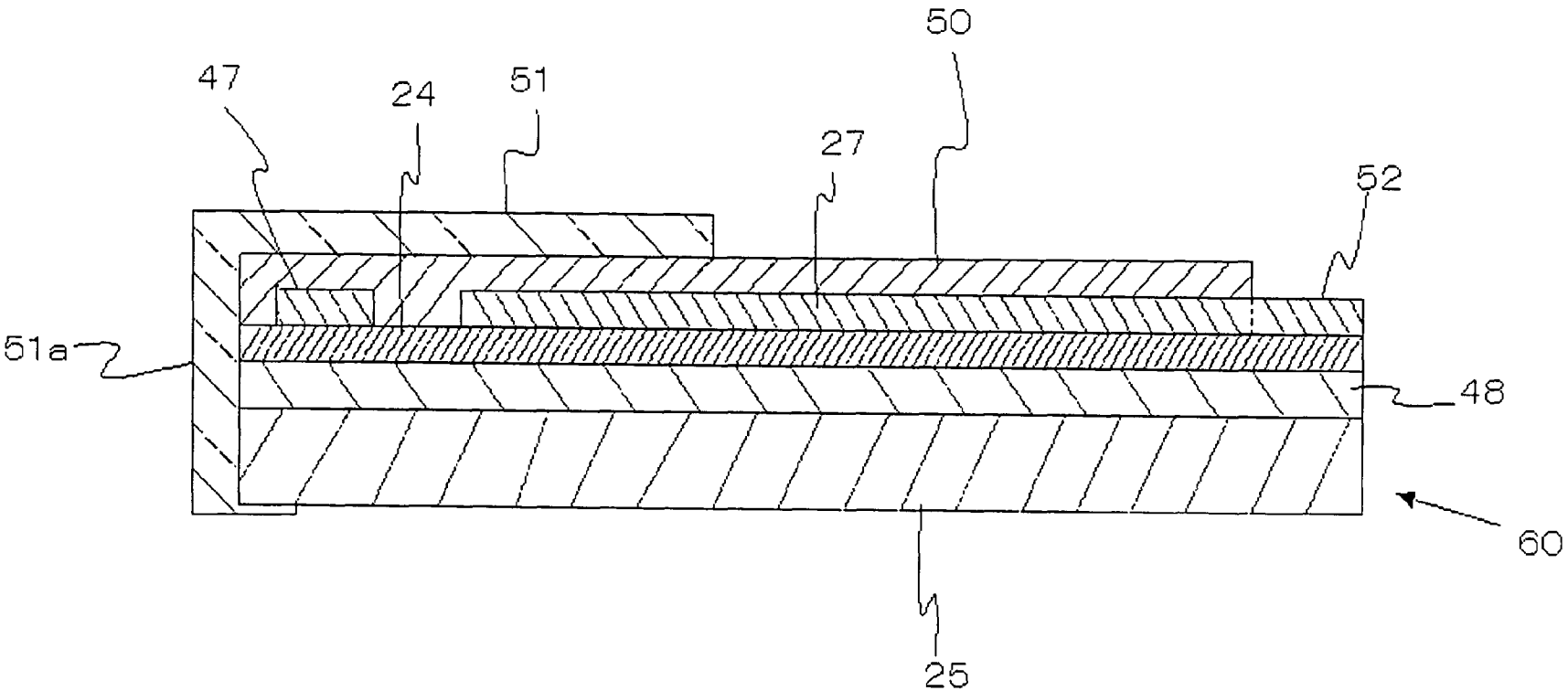
FIG. 12 is a cross sectional view of the thermal head formed on the substrate during manufacture of the thermal head according to the first embodiment of the present invention.
Figure 13:
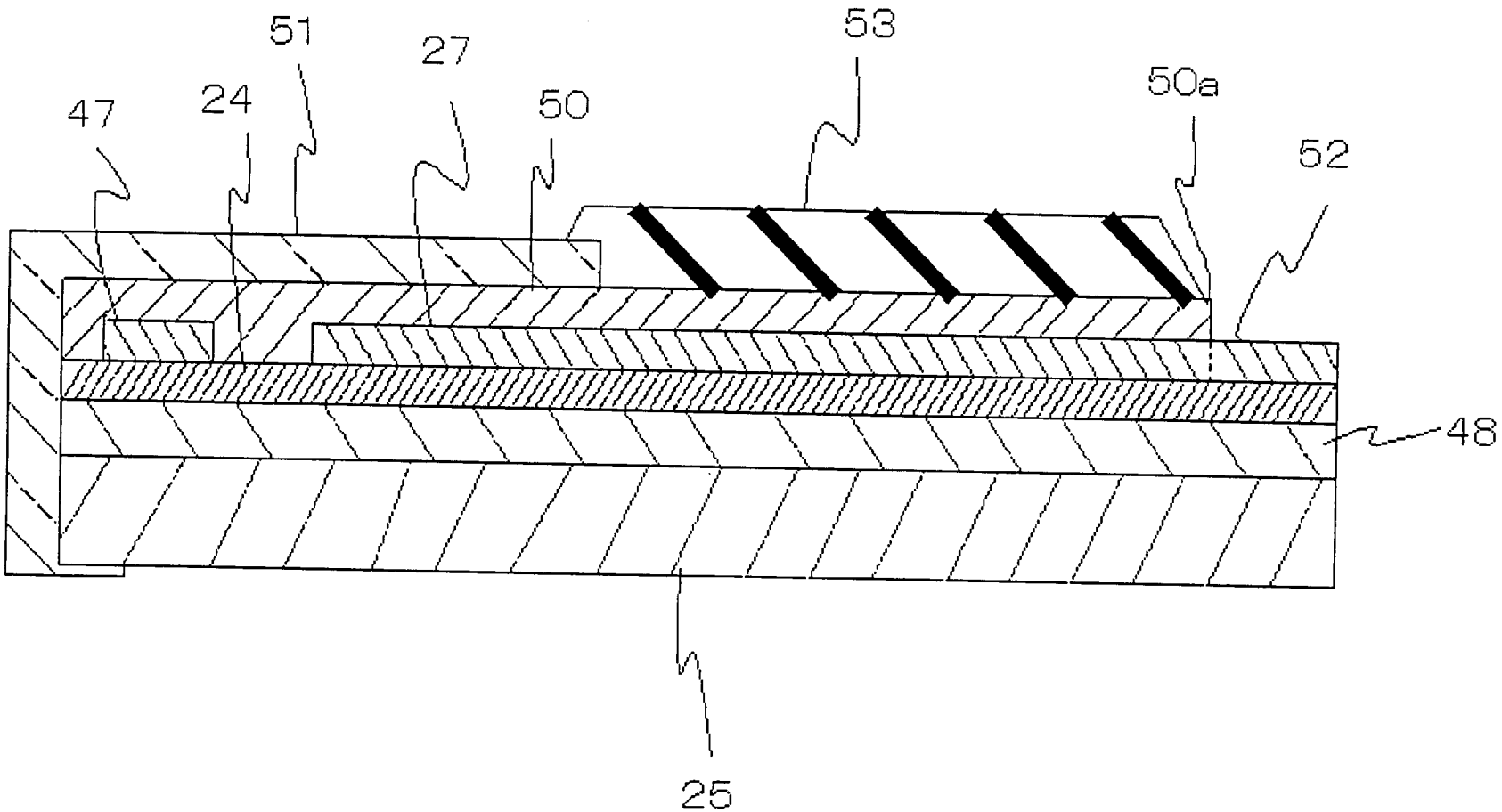
FIG. 13 is a cross sectional view of the thermal head formed on the substrate during manufacture of the thermal head according to the first embodiment of the present invention.

The step S15 involves masking the substrate 60, which has been divided in the step S14, so as to expose a portion of the substrate 60, the portion covering the protective layer 51 located on the side having the heat elements 24 located thereon and stacking the layer 51 on the substrate 60. In the step S15, as shown in FIG. 10, the insulating-layer-covering substrate 60 has a mask 61 applied thereon so as to expose the portion covered by the protective layer 51. With the insulating-layer-covering substrate 60 having a mask 61 applied thereon, the thin film forming technique, such as the plasma CVD, is applied to form a SiBP film as the protective layer 51 at a temperature of approximately 400 C. by use of silane, diborane, and phosphine as raw material gases. The raw gasses for the layer 51 spread first straight and then curve generally in a U form so that the layer 51 is continuously formed to cover the front wall 25*a* of the substrate 25 and to extend to the backside 25*b* of the substrate 25 (FIG. 11). In order to ensure for the raw material gases to curve generally in a U form so as to reliably reach the backside (corresponding to the lower surface in the figure) of the substrate 60, the substrate 60 may be tilted to a certain degree.

The step S16 involves dry etching the insulating layer 50*b* covering the bonding pad portion 52. This dry etching uses, for example, $CHF_3$ and $O_2$ as the etching gases. (See FIG. 12).

The step S17 involves covering the insulating layer 50 with the resin layer 53. The covering reaches the end 50*a* of the insulating layer 50. The end 50*a* is located on one side of the insulating layer 50, the side having the bonding pad portion 52 located thereon. Subsequently, the resin is heat hardened at an appropriate temperature. This accomplishes the step of covering the resin layer 53. (See FIG. 13.)

First, the step S18 involves adhering the substrate 25 on the mount 21 via an electrically conductive adhesive 55, etc. Second, subsequently, the step S18 involves securing the integrated circuit 26 on the mount 21. Third, subsequently, the step S18 involves electrically connecting subsequently the heat elements 24 and the integrated circuit 26 via the bonding wire 28. Finally, the step S18 involves applying the epoxy resin (protective resin) 29 so as to cover the circuit 26 and the wire 28. With this configuration, the epoxy resin (protective resin) 29 is cured.

Thus, the manufacture of a thermal head has been completed. The thermal head is shown in FIG. 6(*a*). In view of enhanced effectiveness of the manufacture, when stacking the protective layer 51 on the substrate 60, it would be preferable that there be at least two substrates 60 stacked one on another. In this case, an immediately overlying substrate 60 serves as a mask for an immediately underlying mask.

Figure 17:
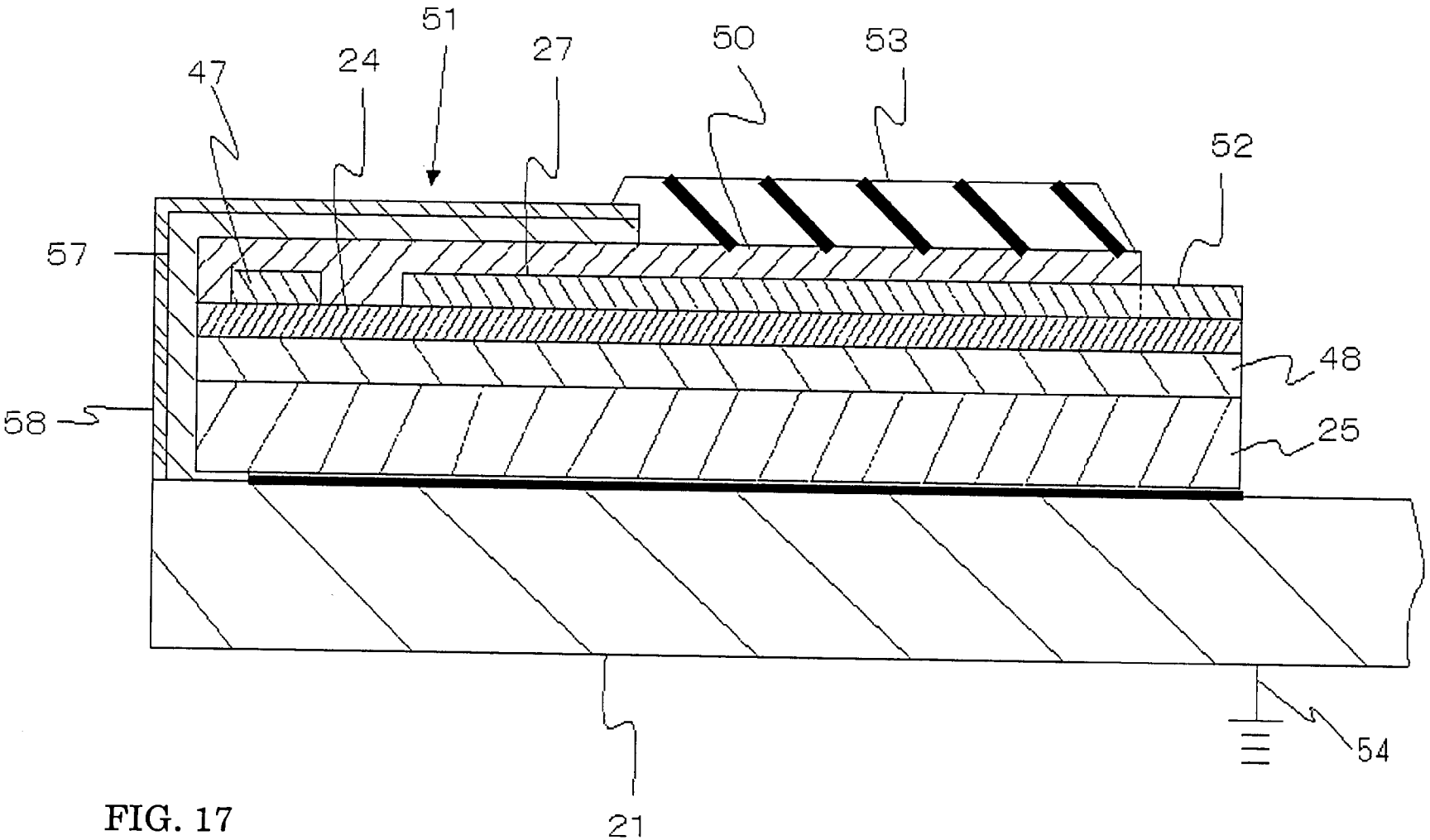
FIG. 17 is a partial cross sectional view of a printing device according to the fifth embodiment of the present invention.

Regarding the thermal head manufactured by use of the above manufacture method, the amount of charge thereof was evaluated. The method for evaluating the amount of charge was carried out as follows. First, a printing paper was moved along while being pressed against the protective layer 51, as is the case with the printing operation. Subsequently, the charge amount measuring machine of the type KSD-0303 (Kasuga Electric Works Ltd.) was used to measure the amount of charge. If a SiBP film having a surface resistance of $5\times10^9$ Ω/square is used as the protective film 51, a conventional product as shown in FIG. 17 had an amount of charge of −1350 V. This embodiment resulted in −10 V. The results showed this embodiment to considerably decrease the amount of charge in comparison with the conventional product.

The thermal head manufactured as described above is electrically connected to the metallic mount 21. This is realized by the following. First, the protective layer 51 is continuously formed so as to cover a front wall 25*a* of the substrate 25 and to extend to the backside 25*b* of the substrate 25. Second, the protective layer 51, which is thus formed so as to extend to the backside 25*b* of the substrate, is then electrically connected with the metallic mount 21, which is realized by adhering the substrate 25 on the mount 21 via an electrically conductive adhesive 55, etc. This configuration makes it possible to dissipate the electrostatic charge accumulated on the surface of the layer 51 during printing operation to ground through the portion 51*a* covering the front wall 25*a* of the substrate 25 and through the mount 21. This prevents electrostatic discharge damage from occurring in the heat elements 24 and the bonding pad portion 52. This makes it possible to obtain a highly reliable thermal head and a highly reliable printing device provided with the thermal head.

Second Embodiment

Figure 14:
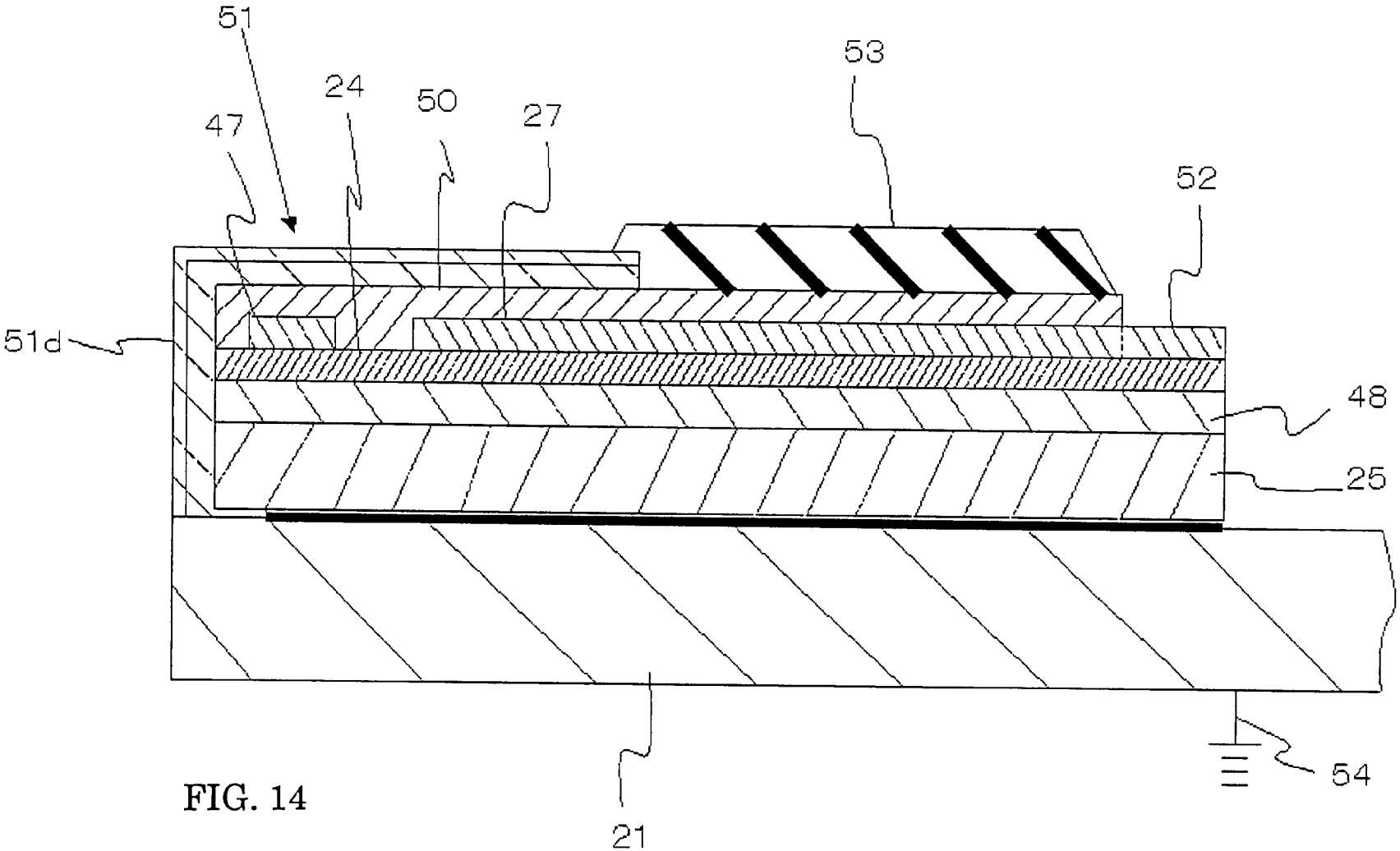
FIG. 14 is a partial cross sectional view of the printing device according to the second embodiment of the present invention.

FIG. 14 is a partial cross sectional view of a thermal head according to the second embodiment of the present invention. FIG. 14 corresponds to FIG. 6(*a*) referred to in connection with the first embodiment. The second embodiment involves increasing the electric conductivity of the surface layer 51*d* of the protective layer 51. Except for this, the second embodiment is the same as the first embodiment. The manufacture method of the first embodiment includes the step S15. This step involves stacking the layer 51 on the substrate 60. In the second embodiment, when performing this stacking, the layer 51 is doped with an adequate amount of an adequate impurity. This aims to realize the following (1) and (2). (1) The layer 51 contains an electrically insulating region defined by a predetermined thickness measured from the interface 50*c* of the insulating layer 50. (2) The layer 51 contains also an electrically conductive region defined by a predetermined depth measured from the upper surface of the layer 51. In the second embodiment also, the substrate 25 has the glaze 48 formed thereon, as is the case with the first embodiment. The glaze 48 has the heat elements 24 provided thereon. The heat elements 24 are spaced apart from each other by a predetermined distance in the longitudinal direction (corresponding to a direction vertical to the plane of paper containing FIG. 14) of the glaze 48. The glaze 48 is also provided with the wiring patterns 24 and 47 and the bonding pad portion 52. The wiring patterns 24 and 47 are spaced apart from each other by a predetermined distance in the longitudinal direction (a direction vertical to the plain of paper containing FIG. 14) of the thermal head. The wiring patterns 27 and 47 are formed by removing the conductive layer such that part of the entire area of the heat elements 24 is exposed. The heat elements 24 and the wiring patterns 27 and 47 are covered by the insulating layer 50. Part of the insulating layer 50 is covered by the protective layer 51. Part of the insulating layer 50 is covered by the resin layer 53. The protective layer 51 is continuously formed so as to cover a front wall 25*a* of the substrate 25 and to extend to the backside 25*b* of the substrate 25. The protective layer 51, which is thus formed so as to extend to the backside 25*b* of the substrate, is then electrically connected with the metallic mount 21. This is realized by adhering the substrate 25 on the mount 21 via an electrically conductive adhesive 55, etc. The mount 21 is grounded. This is indicated by reference number 54. The resin layer 53 is made of an epoxy resin. As noted above, the second embodiment involves increasing the electric conductivity of the surface layer 51*d* of the protective layer 51. This increase makes it possible to dissipate the electrostatic charge accumulated on the surface 51*d* of the layer 51 during printing operation to ground through the portion 51*a* covering the front wall 25*a* of the substrate 25 and through the mount 21. This prevents electrostatic discharge damage from occurring in the heat elements 24 and the bonding pad portion 52. This makes it possible to obtain a highly reliable thermal head and a highly reliable printing device provided with the thermal head.

Third Embodiment

Figure 15:
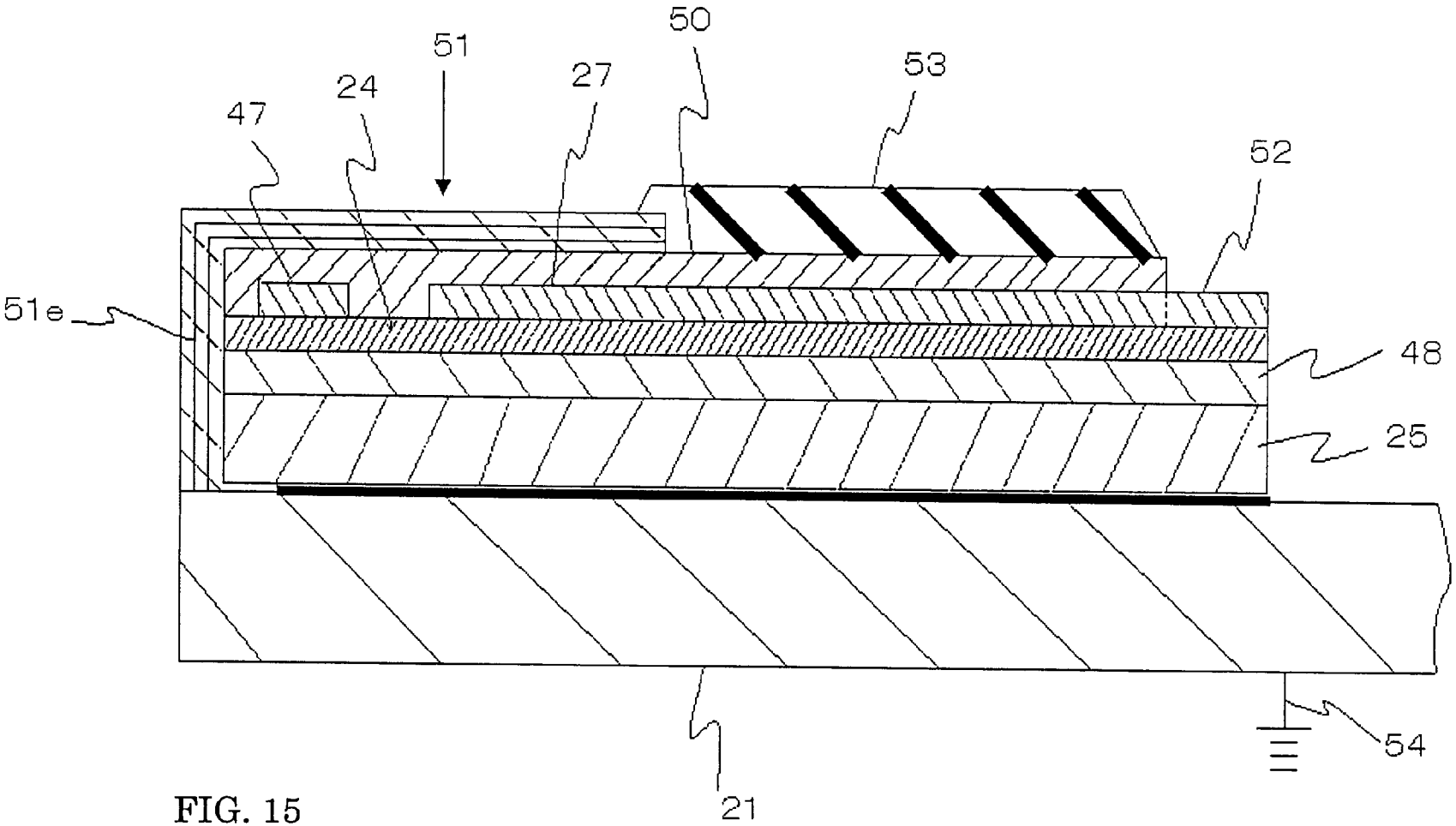
FIG. 15 is a partial cross sectional view of the printing device according to the third embodiment of the present invention.

FIG. 15 is a partial cross sectional view of a thermal head according to the third embodiment of the present invention. FIG. 15 corresponds to FIG. 6(*a*) referred to in connection with the first embodiment. The third embodiment involves increasing the electric conductivity of the middle layer 51*e* of the protective layer 51. Except for this, the third embodiment is the same as the first embodiment. The manufacture method of the first embodiment includes the step S15. This step involves stacking the layer 51 on the substrate 60. In the third embodiment, when performing this stacking, the layer 51 is doped with an adequate amount of an adequate impurity. This aims to realize the following (1), (2), and (3). (1) The layer 51 contains an electrically insulating region defined by a predetermined thickness measured from the interface 50*c* of the insulating layer 50. (2) The layer 51 contains also another electrically insulating region defined by a predetermined depth measured from the upper surface of the layer 51. (3) the middle layer 51*e* contains also an electrically conductive region interposed between the above two electrically insulating regions. In the third embodiment also, the substrate 25 has the glaze 48 formed thereon, as is the case with the first embodiment. The glaze 48 has the heat elements 24 provided thereon. The heat elements 24 are spaced apart from each other by a predetermined distance in the longitudinal direction (corresponding to a direction vertical to the plane of paper containing FIG. 15) of the glaze 48. The glaze 48 is also provided with the wiring patterns 24 and 47 and the bonding pad portion 52. The wiring patterns 24 and 47 are spaced apart from each other by a predetermined distance in the longitudinal direction (a direction vertical to the plain of paper containing FIG. 15) the thermal head. The wiring patterns 27 and 47 are formed by removing the conductive layer such that part of the entire area of the heat elements 24 is exposed. The heat elements 24 and the wiring patterns 27 and 47 are covered by the insulating layer 50. Part of the insulating layer 50 is covered by the protective layer 51. Part of the insulating layer 50 is covered by the resin layer 53. The protective layer 51 is continuously formed so as to cover the front wall of the substrate 25 and to extend to the backside of the substrate 25. The protective layer 51, which is thus formed so as to extend to the backside of the substrate, is then electrically connected with the metallic mount 21. This is realized by adhering the substrate 25 on the mount 21 via an electrically conductive adhesive 55, etc. The mount 21 is grounded. This is indicated by reference number 54. The resin layer 53 is made of an epoxy resin. This configuration makes it possible to dissipate the electrostatic charge accumulated on the surface of the layer 51 during printing operation to ground through the intermediate layer 51*e* and through the mount 21. This prevents electrostatic discharge damage from occurring in the heat elements 24 and the bonding pad portion 52. This makes it possible to obtain a highly reliable thermal head and a highly reliable printing device provided with the thermal head.

Fourth Embodiment

Figure 16:
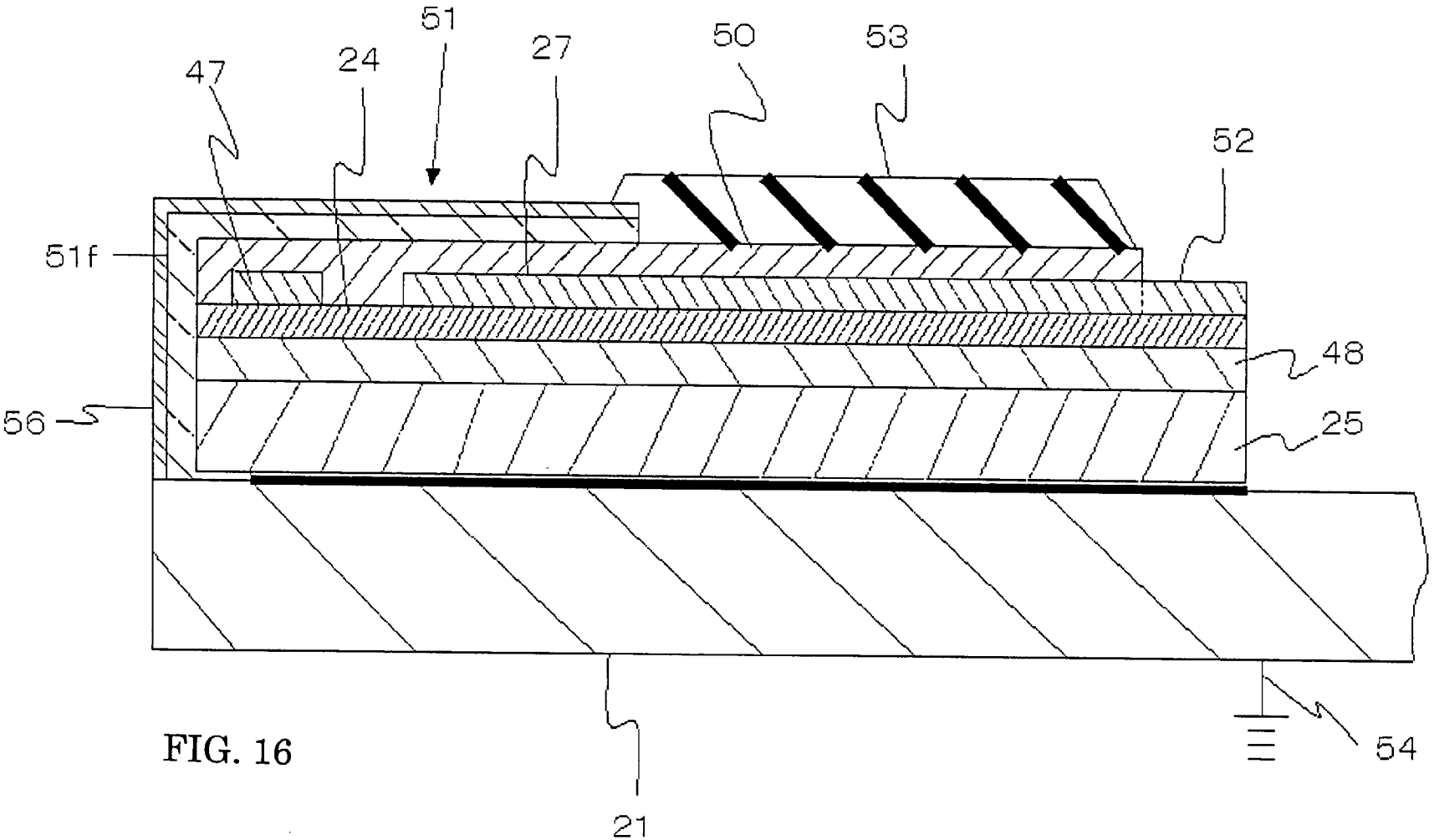
FIG. 16 is a partial cross sectional view of a printing device according to the fourth embodiment of the present invention.

FIG. 16 is a partial cross sectional view of a thermal head according to the fourth embodiment of the present invention. FIG. 16 corresponds to FIG. 6(*a*) referred to in connection with the first embodiment. The fourth embodiment involves increasing the electric conductivity in that the surface 51*f* of the protective layer 51 in the first embodiment has a metallic layer 56, such as one made of the tungsten. Except for this, the fourth embodiment is the same as the first embodiment. The manufacture method of the first embodiment includes the step S15. This step involves stacking the layer 51 on the substrate 60. In the fourth embodiment, when performing this stacking, the layer 51 is formed as follows. First, an insulator is stacked, as part of the layer 51, on the substrate 60. The insulator occupies the region defined by a predetermined thickness from the interface of the insulating layer. Subsequently, a metallic layer, such as one made of the tungsten, is, also as part of the layer 51, stacked on the insulator. The glaze 48 has the heat elements 24 provided thereon. The heat elements 24 are spaced apart from each other by a predetermined distance in the longitudinal direction (corresponding to a direction vertical to the plane of paper containing FIG. 16) of the glaze 48. The glaze 48 is also provided with the wiring patterns 24 and 47 and the bonding pad portion 52. The wiring patterns 24 and 47 are spaced apart from each other by a predetermined distance in the longitudinal direction (a direction vertical to the plain of paper containing FIG. 15) the thermal head. The wiring patterns 27 and 47 are formed by removing the conductive layer such that part of the entire area of the heat elements 24 is exposed. The heat elements 24 and the wiring patterns 27 and 47 are covered by the insulating layer 50. Part of the insulating layer 50 is covered by the protective layer 51. Part of the insulating layer 50 is covered by the resin layer 53. The protective layer 51 is continuously formed so as to cover the front wall of the substrate 25 and to extend to the backside of the substrate 25. The protective layer 51, which is thus formed so as to extend to the backside of the substrate, is then electrically connected with the metallic mount 21. This is realized by adhering the substrate 25 on the mount 21 via an electrically conductive adhesive 55, etc. The mount 21 is grounded. This is indicated by reference number 54. The resin layer 53 is made of an epoxy resin. This configuration makes it possible to dissipate the electrostatic charge accumulated on the surface of the layer 51 during printing operation to ground through the intermediate layer 51*e* and through the mount 21. This prevents electrostatic discharge damage from occurring in the heat elements 24 and the bonding pad portion 52. This makes it possible to obtain a highly reliable thermal head and a highly reliable printing device provided with the thermal head.

Regarding the thermal head manufactured by use of the above manufacture method, the amount of charge thereof was evaluated by use of the measurement method as described above with reference to the first embodiment. The measurement was 0V. This amount of charge is considerably decreased compared with the amount of charge of −1350 V shown by the conventional product. This configuration makes it possible to dissipate the electrostatic charge accumulated on the surface of the layer 51 during printing operation to ground through the metallic layer 56 and through the mount 21. This prevents electrostatic discharge damage from occurring in the heat elements 24 and the bonding pad portion 52. This makes it possible to obtain a highly reliable thermal head and a highly reliable printing device provided with the thermal head.

Fifth Embodiment

FIG. 17 is a partial cross sectional view of a thermal head according to the fifth embodiment of the present invention. FIG. 17 corresponds to FIG. 6(*a*) referred to in connection with the first embodiment. As noted above, the first embodiment has the insulating layer 50 (referred to also as a first insulating layer 50 in the fifth embodiment) having the protective layer 51 formed thereon. By contrast, the fifth embodiment has the first insulating layer 50, an electrically conductive layer 57, and an insulating layer 58, in this order from bottom, disposed therein. The insulating layer 58 is different than the first insulating layer 50 and will be referred to as a second insulating layer 58 hereinafter. The electrically conductive layer 57 and the second insulating layer 58 in the fifth embodiment together correspond to the layer 50 in the first embodiment. Except for this, the fourth embodiment is the same as the first embodiment.

The manufacture method of the first embodiment includes the step S15. This step involves stacking the layer 51 on the substrate 60. In the fifth embodiment, this corresponds to the following. First, the first insulating layer 50 is formed. The first insulating layer 50 occupies the region defined by a predetermined thickness from the upper surface of the heat element 24. The first insulating layer 50 has then the electrically conductive layer 57 stacked thereon. The layer 57 is made of the tungsten, etc. The first insulating layer 50 has then the second insulating layer 58 formed thereon. In the fifth embodiment, the protective layer 51 is continuously formed so as to cover the front wall of the substrate 25 and to extend to the backside of the substrate 25. The protective layer 51, which is thus formed so as to extend to the backside of the substrate, is then electrically connected with the metallic mount 21. This is realized by adhering the substrate 25 on the mount 21 via an electrically conductive adhesive 55, etc. The mount 21 is grounded. This is indicated by reference number 54. The resin layer 53 is made of an epoxy resin. This configuration makes it possible to dissipate the electrostatic charge accumulated on the surface of the layer 51 during printing operation to ground through the intermediate layer 51*e* and through the mount 21. This prevents electrostatic discharge damage from occurring in the heat elements 24 and the bonding pad portion 52. This makes it possible to obtain a highly reliable thermal head and a highly reliable printing device provided with the thermal head. In general, the outermost surface of the head slides against the recording medium and hence must be resistant to abrasion. The above configuration makes it possible to render each of the above layers electrically conductive so as to prevent electrostatic discharge damage. The above configuration also makes it possible to render each of the above layers resistant to abrasion.

In the above method for manufacture of the thermal head, when forming continuously the electrically conductive layer 57 and the second insulating layer 58, this causes generally the U form curvature of the second insulating layer 58 to constitute the outermost surface. This prevents the electrical connection to the mount. In order to avoid this, the substrate 25 is tilted by a different angle when forming the layer 57 or when forming the second insulating layer 58. That is, the substrate 25 is tilted larger when forming 57 than when forming the second insulating layer 58. The layer 57 curves thereby over the larger length than the second insulating layer 58. This makes it possible to reliably realize the electrical connection to the mount 21.

In this embodiment, the protective layer 51 is configured to cover the front wall of the substrate 25. Alternatively, the layer 51 is configured to cover the side wall of the substrate 25. Alternatively, the layer 25 is configured to cover both the front and side walls of the substrate 25.

This embodiment has been described with reference to the printing thermal head and with reference to the case of plural heat elements being provided. Alternatively, this embodiment may be used for an erasing thermal head composed of one single heat element.

Sixth Embodiment

Figure 18A:
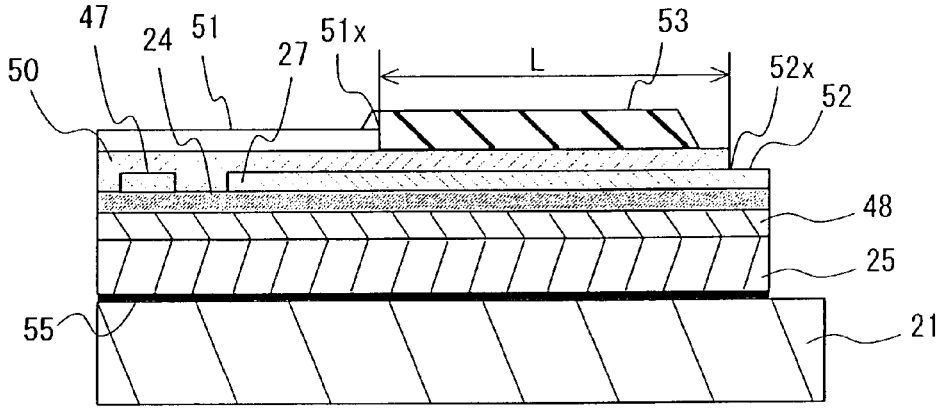
FIG. 18(*a*) is a cross sectional view of FIG. 4 taken along the line C-C according to the sixth embodiment of the present invention.
Figure 18B:
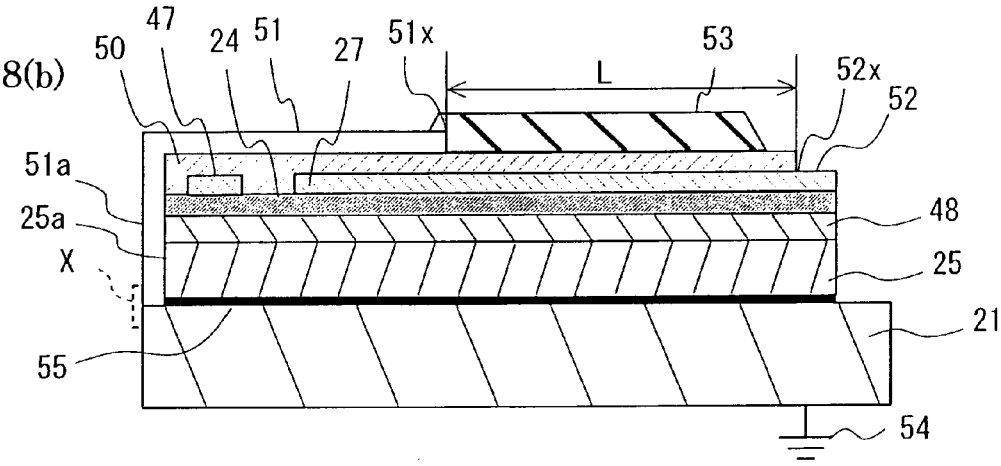
Figure 18C:
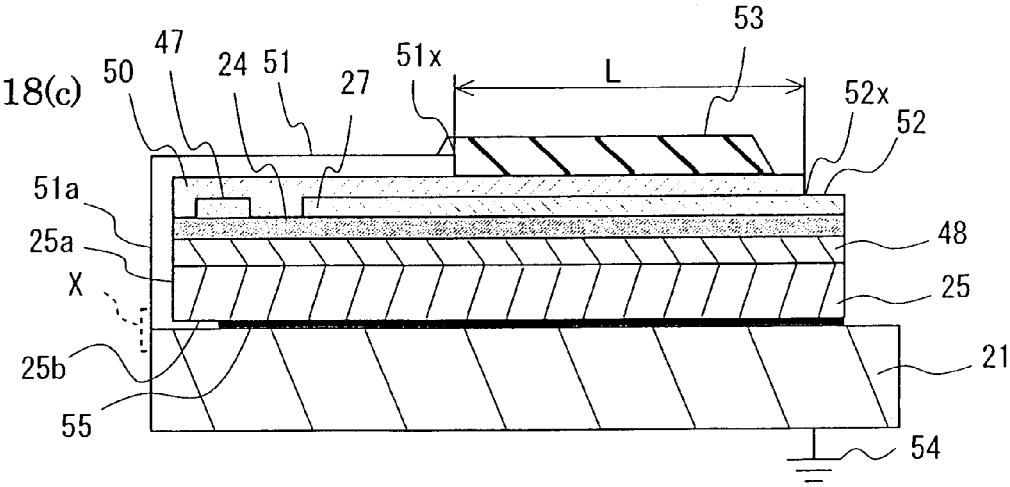

FIG. 18(*a*) is a cross sectional view taken along the line C-C shown in FIG. 4. FIGS. 18(*b*) and (*c*) each show a variant example. FIG. 18(*a*) shows the mount 21 having the substrate 25 adhered thereon. The substrate 25 has the glaze 28 formed thereon. The glaze 48 has the heat elements 24 formed thereon. The heat elements 24 are spaced apart from each other by a predetermined distance in the longitudinal direction (corresponding to a direction vertical to the plane of paper containing FIG. 18) of the glaze 48. The glaze 48 is also provided with the wiring patterns 24 and 47 and the bonding pad portion 52. The wiring patterns 24 and 47 are spaced apart from each other by a predetermined distance in the longitudinal direction (a direction vertical to the plain of paper containing FIG. 18) of the thermal head. The wiring patterns 27 and 47 are formed by removing the conductive layer such that part of the entire area of the heat elements 24 is exposed. The heat elements 24 and the wiring patterns 27 and 47 are covered by the insulating layer 50. Part of the insulating layer 50 is covered by the protective layer 51.

The surface resistance of the layer 51 is preferably $1\times10^{11}$ Ω/square or less in order to obtain the effect of eliminating electrostatic charge. The layer 51 and the wiring pattern 47, which is constituted by a layer composed of electrodes, are prevented from contacting each other by the leftmost portion of the left end of the pattern 47 being replaced by the corresponding portion of the insulating layer 50. The distance L extends in the area where the layer 50 is not covered by the layer 51. The distance L extends from the end 51X of the layer 51 to the end 52X of the bonding pad portion 52. The end 52X is such that the portion 52 is covered by the layer 50 on one side of the end 52X, the side having the layer 51 located thereon, whereas the portion 52 is exposed on the other side of the end 52X. The distance L is set to be larger than a predetermined length.

FIG. 19 shows the test results regarding the relation between the distance L and the occurrence frequency of electrostatic corrosions (breakdowns).

The test was conducted under the following conditions.

Insulating layer 50:

Material: SiON

Film thickness: 1 μm (in the area having the protective layer 51 formed therein)

Protective layer 51:

Material: SiBP

Film thickness: 7 μm

Surface resistance: $9\times10^{9}$ Ω/square

The method of evaluation is as follows. In order to reproduce the state of the protective layer 51 being electrostatically charged during printing operation, the layer 51 was applied to with a constant voltage (300 volts direct current) to simulate the state of being electrostatically charged. The heat dots (a dot defined as a pair of heat elements as noted above) were then driven under normal conditions. The occurrence frequency of electrostatic corrosions (referred to merely as an "occurrence frequency" hereinafter) at the bonding pad portion 52 was thereby measured.

As shown in the test results, when the distance L is 0 μm, the occurrence frequency is 9.5%. When the distance L is 10 to 20 μm, the occurrence frequency is approximately halved to 5.1%. When the distance L is 50 to 60 μm, the occurrence frequency is 1.2%. When the distance L is 90 to 100 μm, the occurrence frequency is 0.0%.

From the above, it would be preferable that the distance L from the end 51X of the protective layer 51 to the end 52X of the boding pad portion 52 be larger than 10 μm in the area where the insulating layer 50 is not covered by the protective layer 51. The end 52X is located on the side having the protective layer 51 located thereon. It would be more preferable that the distance L be larger than 50 μm in this case. It would be still more preferable that the distance L be larger than 90 micrometers in this case.

FIGS. 18(*b*) and (*c*) show each a variant example of the thermal head. In these variant examples, the protective layer 51 (51*a*) is configured to cover the front wall 25*a* (left in the figure) of the substrate 25. In particular, in FIG. 18(*c*), the protective layer 51 (51*a*) is continuously formed so as extend to the backside 25*b* of the substrate 25. The protective layer 51 (51*a*), which is thus formed to extend to the backside 25*b* of the substrate, is then electrically connected with the metallic mount 21. This is realized by adhering the substrate 25 on the mount 21 via an electrically conductive adhesive 55, etc. The mount 21 is grounded. In order to improve the electrical connection between the mount 21 and the protective layer 51 (51*a*) configured to extend first straight and then curve generally in a U form to form a curved portion 51*a*, the area indicated by the symbol X may be provided with an electrically conductive material, such as an electrically conductive adhesive. In this configuration, it is possible to use a general adhesive instead of an electrically conductive adhesive for adhering the mount 21 and the substrate 25 to each other. In these variant examples, the electrostatic charge accumulated in the layer 51 is dissipated to ground potential through the mount 21. This results in reduced electrostatic charge accumulation. Therefore, if the distance L specified above is realized by the layer 51, the layer 50, and the bonding pad portion 52 being formed accordingly, the degree of electrostatic charge corrosion can be decreased in equal or larger measure in comparison with the thermal head shown in FIG. 18(*a*).

As described above, the thermal head according to this embodiment has the protective layer 51 and the bonding pad portion 52 designed to be spaced apart from each other by an adequate distance. This prevents electrostatic discharge damage from occurring in the layer 51 and in the portion 52. This makes it possible to obtain a highly reliable thermal head and a highly reliable printing device provided with the thermal head.

Figure 21:
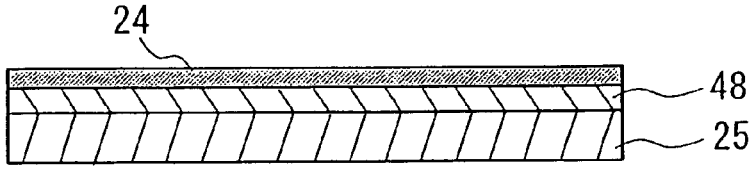
FIGS. 21(*a*) to (*g*) are each cross sectional view of the thermal head formed on the substrate during manufacture of the thermal head according to the sixth embodiment of the present invention.
Figure 21:
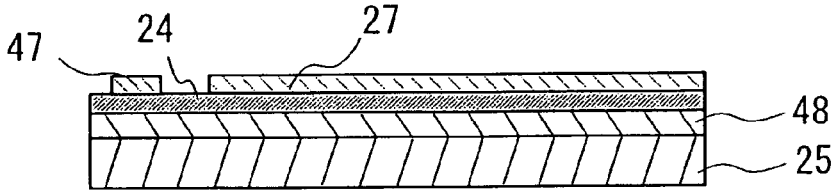
Figure 21:
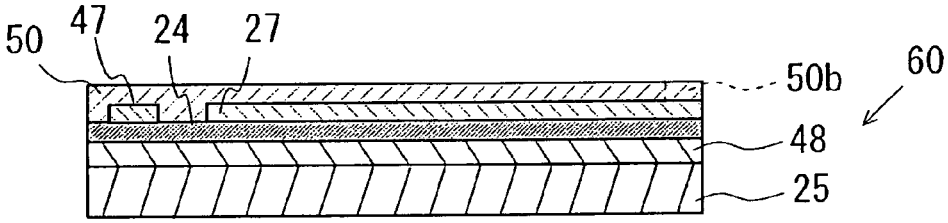
Figure 21:
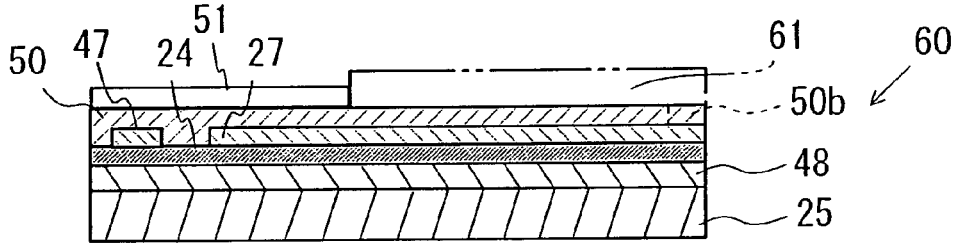
Figure 21:
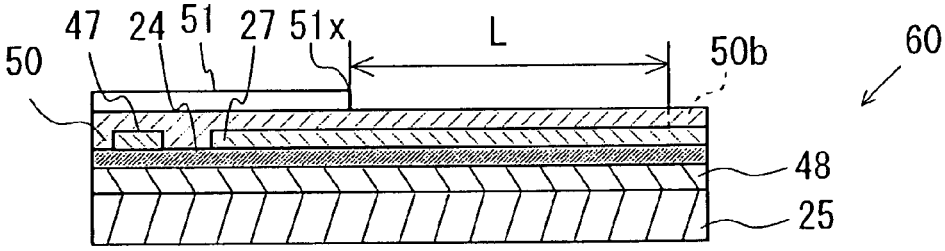
Figure 21:
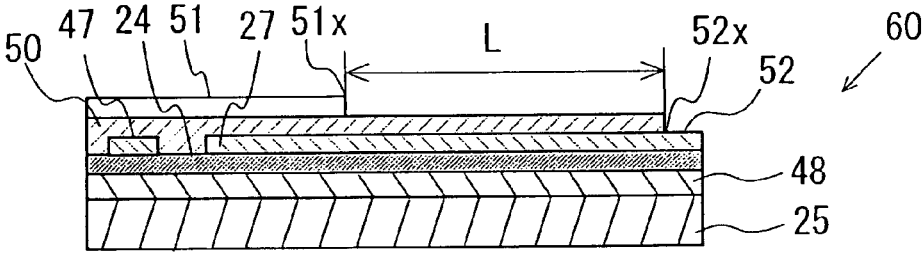
Figure 21:
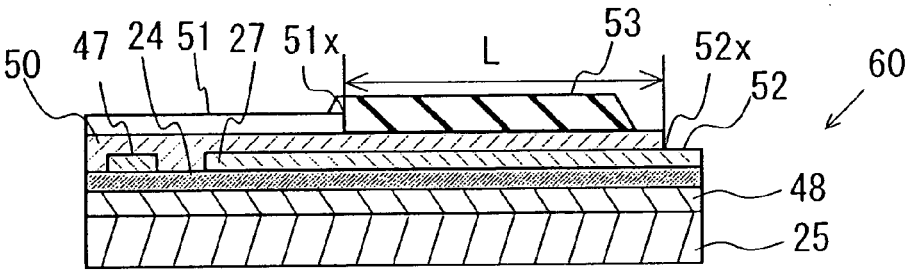

The method for manufacture of the thermal head according to the embodiment of the present invention will be blow described with reference to FIGS. 19 and 21. The thermal head shown in FIG. 18(*a*) will be primarily referred to.

Figure 20:
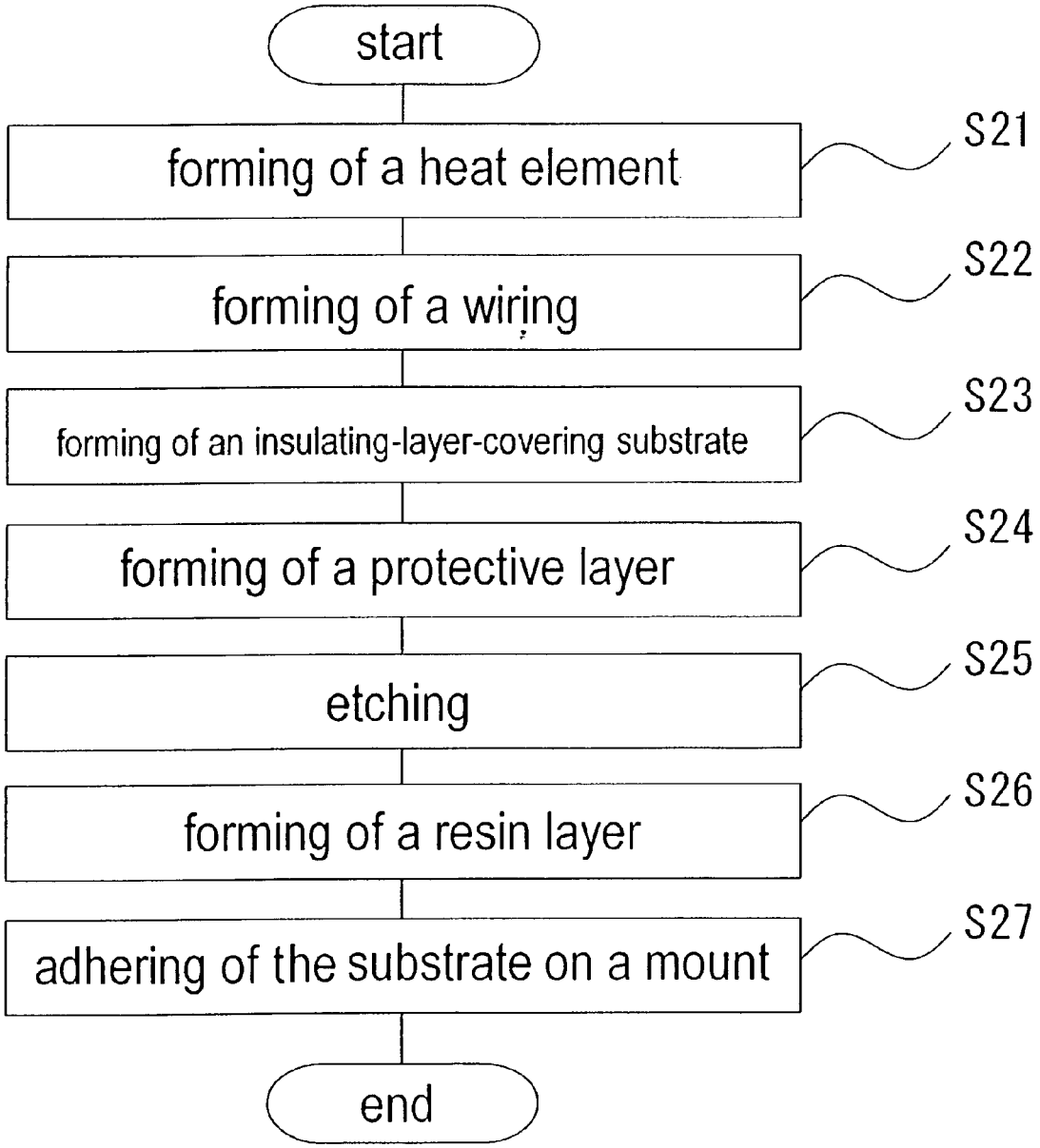
FIG. 20 is a flow chart of the method of manufacture of the thermal head according to the sixth embodiment of the present invention.

FIG. 20 is a flow chart illustrative of the method for manufacture of the thermal head according to the embodiment of the present invention. FIGS. 21(*a*) to (*g*) are each a cross sectional view of the thermal head formed on the substrate 25 at each step included in this method.

First, the step S21 is the step of forming the heat elements 24 on the substrate 25. As shown in FIG. 21(*a*), the substrate 25 has the glaze 48 formed thereon. This is realized by screen printing, etc. The glaze 48 has the heat elements 24 formed thereon. This is realized by the thin film forming technique (FIG. 8(*c*)). This technique is, for example, the vacuum evaporation, the chemical vapor deposition (CVD), the sputtering, etc. The low pressure CVD (LP-CVD), for example, is used to form the heat elements 24 on the glaze 48. Subsequently, the photolithography and the etching are used so as for the heat elements 24, which has been thus formed as thin films, to be spaced apart from each other by a predetermined distance in the longitudinal direction (corresponding to a direction vertical to the plane of paper containing FIG. 21) of the glaze 48.

The step S22 is the step of forming the wiring patterns 27 and 47, and the bonding pad portion 52. The whole surface of the heat elements 24 of the substrate 25 has an electrically conductive layer formed thereon. The conductive layer is made of aluminum or an aluminum alloy. The conductive layer is later etched, thereby resulting in the wiring patterns 27 and 47. The conductive layer may be formed by the thin film forming technique, such as the sputtering. The conductive layer may also be formed by the screen printing method. The conductive layer is then patterned via the photolithography and the etching into a desired configuration. More specifically, the wiring patterns 27 and 47 are formed to be spaced apart from each other by a predetermined distance in the longitudinal direction (corresponding to the primary scanning direction) of the thermal head, as shown in FIG. 4. In addition, the conductive layer is partially removed so as to expose part of the whole area of the heat elements 24, thereby resulting in the wiring patterns 27 and 47 and the bonding pad portion 52 as shown in FIG. 21(*b*). A predetermined portion of the wiring patter 27, the portion located right in FIG. 21(*b*), will be made the bonding pad portion 52 in a step described later (for example, see FIG. 18 or FIG. 21(*f*)).

The step S23 is the step of forming an insulating-layer-covering substrate 60. As shown in FIG. 21(*c*), the patterns 27 and 47 are covered with the insulating layer 50. The heat elements 24 and the wiring patterns 27 and 47 have an inorganic substance, such as $SiO_2$, etc., stacked thereon via the sputtering, etc., to form the insulating layer 50.

The step S24 is the step of forming an insulating-layer-covering substrate 60. As shown in FIG. 21(*d*), the substrate 60 has a mask 61 applied thereon so as to expose a portion of the substrate 60, the portion covering the protective layer 51 located on the side having the heat elements 24 located thereon and stacking the layer 51 on the substrate 60. With the insulating-layer-covering substrate 60 having a mask 61 applied thereon, the thin film forming technique, such as the plasma CVD, is applied to form a SiBP film as the protective layer 51 at a temperature of approximately 400 degrees Celsius by use of silane, diborane, and phosphine as raw material gases. FIG. 21(*e*) shows the state of the mask 61 being removed.

In the variant example shown in FIG. 18(*b*), the raw gasses for the layer 51 is caused to spread first straight and then curve generally in a U form so that the layer 51 is continuously formed to cover the front wall 25*a* of the substrate 25. In the variant example shown in FIG. 18(*c*), the layer 51 is continuously formed to extend to the backside 25*b* of the substrate 25. In order to ensure for the raw material gases to curve generally in a U form so as to reliably reach the backside of the substrate 60, the substrate 60 may be tilted to a certain degree.

The step S25 involves dry etching. As shown in FIG. 21(*f*), the insulating layer 50 covering the bonding pad portion 52 is dry etched. A portion of the wiring pattern 27 is exposed as the bonding pad portion 52. The portion is the right end of the pattern 27 in the figure. This dry etching uses, for example, $CHF_3$ and $O_2$ as the etching gases. As noted above, it would be preferable that the distance L from the end 51X of the protective layer 51 to the end 52X of the boding pad portion 52 be larger than 10 micrometers. The end 52X is located on the side having the protective layer 51 located thereon. It would be more preferable that the distance L be larger than 50 μm in this case. It would be still more preferable that the distance L be larger than 90 μm in this case.

The step S26 is the step of forming the resin layer 53. As shown in FIG. 21(*g*), the insulating layer 50 is covered with the resin layer 53. The covering extends from the end 51X of the protective layer 51 to the vicinity of the end 52X of the bonding pad portion 52. Subsequently, the resin layer 53 is heat hardened at an appropriate temperature.

The step S27 is the step of adhering the substrate 25 on the mount 21. The mount 21 has the substrate 25 adhered thereon via an electrically conductive adhesive 55, etc. This results in the configuration shown in FIGS. 18(*a*) to (*c*). As shown in FIG. 3, the integrated circuit 26 is secured on the mount 21. Subsequently, the heat elements 24 and the integrated circuit 26 are electrically connected to each other via the bonding wire 28. The epoxy resin (protective resin) 29 is applied so as to cover the circuit 26 and the wire 28. With this configuration, the epoxy resin (protective resin) 29 is cured.

This has completed the manufacture of the thermal head. Thus, the thermal head shown in FIGS. 18(*a*) to (*c*) is finished. In view of enhanced effectiveness of the manufacture, when stacking the protective layer 51 on the substrate 60, it would be preferable that there be at least two substrates 60 stacked one on another. In this case, an immediately overlying substrate 60 serves as a mask for an immediately underlying mask.

In the variant examples shown in FIGS. 18(*b*) and (*c*), the protective layer 51 is configured to cover the front wall 25*a* of the substrate 25. Alternatively, the layer 51 is configured to cover the side wall of the substrate 25. Alternatively, the layer 25 is configured to cover both the front wall 25*a* and the side wall of the substrate 25.

This embodiment has been described with reference to the printing thermal head and with reference to the case of plural heat elements being provided. Alternatively, this embodiment may be used for an erasing thermal head composed of one single heat element.

All the features of the embodiments described above are merely examples. The present invention is not limited thereto. These examples merely illustrate the present invention so as to enable one skilled in the art to understand and practice the present invention. That is, the present invention is also not limited to these embodiments. Rather, various modifications may be made to these embodiments by one skilled in the art without departing from the spirit and scope of the present invention as claimed in the accompanying claims.

INDUSTRIAL APPLICABILITY

The present invention is applicable to a wide range of: thermal heads to be mounted in various printing devices for business or consumer use; methods for manufacture of thermal heads; and printing devices mounted with thermal heads.

10: printing device
11: casing
12: display panel
13: input keyboard
14: paper outlet
15: thermal paper
16: transport roller
20: thermal head unit
21: mount
22: heat sink
23: connector
24: heat elements
25: substrate
26: integrated circuit (IC)
27: wiring pattern
28: bonding wire
29: protective resin
30: step
31: IC cover
40: individual electrodes
41: common electrodes
50: insulating layer (first insulating layer)
51: protective layer
52: bonding pad portion
53: resin layer
57: conductive layer
58: insulating layer (second insulating layer)
60: insulating-layer-covering substrate

The invention claimed is:

1. A thermal head comprising:
a heat element provided on a substrate;
a wiring pattern electrically connected to the heat element; and
a bonding pad portion, wherein
the heat element is covered by a protective layer,
the substrate is secured to a metallic mount,
the protective layer is electrically connected to the metallic mount,
the protective layer is continuously formed to cover the heat element and a front wall and/or a side wall of the substrate and reach a backside of the substrate,
the protective layer is electrically connected to the metallic mount in that the reaching by the protective layer of the backside of the substrate causes the substrate to contact the metallic mount, and
a surface resistance of the protective layer is $1\times10^{11}$ Ω/square or less when a first insulating layer is provided between the heat element and the protective layer.

2. The thermal head of claim 1, wherein, the first insulating layer provided between the heat element and the protecting layer, i.e. , the first insulating layer, an electrically conductive layer, and a second insulating layer, in this order, are stacked one on another.

3. A printing device using the thermal head of claim 1.

4. A thermal head comprising:

a heat element provided on a substrate;

a wiring pattern electrically connected to the heat element; and a bonding pad portion, wherein the heat element is covered by a protective layer, the substrate is secured to a metallic mount, the protective layer is electrically connected to the metallic mount, the protective layer is continuously formed to cover the heat element and a front wall and/or a side wall of the substrate and reach a backside of the substrate, the protective layer is electrically connected to the metallic mount in that the reaching by the protective layer of the backside of the substrate causes the substrate to contact the metallic mount, and a surface resistance of the protective layer is larger than $1\times10^{6}$ Ω/square and $1\times10^{11}$ Ω/square or less when an insulating layer is not provided between the heat element and the protective layer.

5. A printing device using the thermal head of claim 4.

6. A method for manufacture of a thermal head comprising steps of:

forming heat elements on a raw substrate;

forming wiring patterns electrically connected to the heat elements, along with bonding pad portions, respectively;

dividing the raw substrate to produce divided substrates;

continuously forming a protective layer so as to cover the heat element with the protective layer and then a front wall and/or a side wall of the divided substrate and to further extend to a backside of the divided substrate; and joining the divided substrate and a metallic mount so as to electrically connect the protective layer configured to extend to the backside of the substrate with the metallic mount via an electrically conductive adhesive.

7. A thermal head comprising:

a heat element provided on a substrate;

a wiring pattern electrically connected to the heat element;

an insulating layer formed both on the wiring pattern and the heat element;

a protective layer formed on the insulating layer; and a bonding pad potion configured as a part of the wiring pattern and exposed from the insulating layer, wherein a distance from an end of the protective layer to the bonding pad portion is larger than 10 μm, and the insulating layer covers an area, which is on the wiring pattern, between the end of the protective layer and the bonding pad portion.

8. The thermal head of claim 7, wherein the distance from the end of the protective layer to the bonding pad portion is larger than 50 μm.

9. The thermal head of claim 7, wherein the distance from the end of the protective layer to the bonding pad portion is larger than 90 μm.

10. The thermal head of claim 7, wherein the protective layer is electrically connected to a metallic mount, the metallic mount designed to have the substrate secured thereon.

11. A printing device using the thermal head of claim 7.

12. A method for manufacture of a thermal head, comprising steps of:

forming a heat element on a raw substrate;

forming a wiring pattern electrically connected to the heat element, along with a bonding pad portion;

covering the wiring pattern and the bonding pad portion with an insulating layer;

removing a part of the insulating layer configured to cover the bonding pad portion; and covering the heat element with a protective layer such that the heat element and the bonding pad portion are spaced apart from each other by a predetermined distance or more.

* * * * *